US008449414B2

(12) United States Patent
Donahoe et al.

(10) Patent No.: US 8,449,414 B2
(45) Date of Patent: May 28, 2013

(54) APPARATUS, SYSTEM AND METHOD FOR ELECTRONIC ARCHERY DEVICES

(75) Inventors: Robert V. Donahoe, Newton, MA (US); Jan Vcelak, Kladno (CZ); Paul Chandler Sabin, Needham, MA (US); Jason Evan Avis, Pelham, NH (US)

(73) Assignee: Full Flight Technology, LLC, Newton, MA (US)

( * ) Notice: Subject to any disclaimer, the term of this patent is extended or adjusted under 35 U.S.C. 154(b) by 0 days.

(21) Appl. No.: 12/982,456

(22) Filed: Dec. 30, 2010

(65) Prior Publication Data

US 2011/0172039 A1 Jul. 14, 2011

Related U.S. Application Data

(60) Provisional application No. 61/293,504, filed on Jan. 8, 2010, provisional application No. 61/293,757, filed on Jan. 11, 2010.

(51) Int. Cl.
*F42B 6/04* (2006.01)

(52) U.S. Cl.
USPC ..... 473/582

(58) Field of Classification Search
USPC ..... 473/578, 582, 583, 584
See application file for complete search history.

(56) References Cited

U.S. PATENT DOCUMENTS

| | | | | |
|---|---|---|---|---|
| 3,790,948 | A | | 2/1974 | Ratkovich |
| 4,421,319 | A | | 12/1983 | Murphy |
| 4,547,837 | A | | 10/1985 | Bennett |
| 4,675,683 | A | | 6/1987 | Robinson et al. |
| 4,704,612 | A | | 11/1987 | Boy et al. |
| 4,749,198 | A | | 6/1988 | Brailean |
| 4,845,690 | A | | 7/1989 | Oehler |
| 4,885,800 | A | * | 12/1989 | Ragle ..... 455/98 |
| 4,951,952 | A | * | 8/1990 | Saddler ..... 473/570 |
| 4,989,881 | A | | 2/1991 | Gamble |
| 5,058,900 | A | | 10/1991 | Denen |
| 5,141,229 | A | | 8/1992 | Roundy |
| 5,157,405 | A | | 10/1992 | Wycoff et al. |
| 5,425,542 | A | | 6/1995 | Blackwood et al. |
| 5,988,645 | A | | 11/1999 | Downing |
| 6,027,421 | A | | 2/2000 | Adams, Jr. |
| 6,029,120 | A | | 2/2000 | Dilger |

(Continued)

FOREIGN PATENT DOCUMENTS

KR 200272126 4/2002

OTHER PUBLICATIONS

Paul E. Klopsteg, "Physics of Bows and Arrows", American Journal of Physics, Aug. 1943, vol. 11, pp. 175-192.

(Continued)

*Primary Examiner* — John Ricci
(74) *Attorney, Agent, or Firm* — Rhodes Donahoe LLC

(57) ABSTRACT

According to one aspect, an apparatus is configured to couple to an arrow-mounted electronic device where the apparatus includes a housing, a receptacle included in the housing and at least one electrical contact configured to couple to a contact included in the arrow-mounted electronic device. According to one embodiment, the receptacle is configured to receive at least a portion of the arrow-mounted electronic device, the at least one electrical contact includes a spring-bias in a first direction and the spring bias is opposed with the arrow-mounted electronic device inserted within the receptacle.

41 Claims, 18 Drawing Sheets

U.S. PATENT DOCUMENTS

| | | | | |
|---|---|---|---|---|
| 6,191,574 | B1 | 2/2001 | Dilger | |
| 6,209,820 | B1 | 4/2001 | Golan et al. | |
| 6,390,642 | B1 | 5/2002 | Simonton | |
| 6,604,946 | B2 | 8/2003 | Oakes | |
| 6,612,947 | B2 * | 9/2003 | Porter | 473/578 |
| 6,623,385 | B1 | 9/2003 | Cole et al. | |
| 7,095,312 | B2 | 8/2006 | Erario et al. | |
| 7,115,055 | B2 | 10/2006 | Palomake et al. | |
| 7,165,543 | B2 | 1/2007 | Simo et al. | |
| 7,316,625 | B2 | 1/2008 | Takahashi | |
| 7,331,887 | B1 | 2/2008 | Dunn | |
| 7,337,773 | B2 | 3/2008 | Simo et al. | |
| 7,909,714 | B2 * | 3/2011 | Cyr et al. | 473/578 |
| 7,927,240 | B2 | 4/2011 | Lynch | |
| 7,931,550 | B2 | 4/2011 | Lynch | |
| 7,993,224 | B2 | 8/2011 | Brywig | |
| 8,251,845 | B2 | 8/2012 | Bay | |
| 8,286,871 | B2 | 10/2012 | Bay | |
| 2002/0123386 | A1 | 9/2002 | Perlmutter | |
| 2002/0134153 | A1 | 9/2002 | Grenlund | |
| 2004/0014010 | A1 | 1/2004 | Swensen et al. | |
| 2005/0288119 | A1 | 12/2005 | Wang et al. | |
| 2006/0052173 | A1 | 3/2006 | Telford | |
| 2008/0176681 | A1 | 7/2008 | Donahoe | |
| 2008/0287229 | A1 | 11/2008 | Donahoe | |
| 2010/0248871 | A1 * | 9/2010 | Nick et al. | 473/570 |

OTHER PUBLICATIONS

International Search Report from corresponding International Application No. PCT/US2008/051344 (dated May 14, 2008).

Easton, "Arrow Tuning and Maintenance Guide", Apr. 1999, 2nd Edition, pp. 1-32, Salt Lake City, Utah.

Davey T.W. Fong, Joe C.Y. Wong, Alan H.F. Lam, Raymond H.W. Lam, Wen J. Li, "A Wireless Motion Sensing System Using ADLX MEMS Accelerometers for Sports Science Applications", pp. 5635-5640, Proceedings of the 5th World Congress on Intelligent Control and Automation, Jun. 15-19, 2004, Hangzhou, P.R. China.

Anwar Sadat, Hongwei Qu, Chuanzhao Yu, Jiann S. Yuan, Huikai, "Low-Power CMOS Wireless MEMS Motion Sensor for Physiological Activity Monitoring", IEEE Transactions on Circuits and Systems, Dec. 2005, vol. 52, No. 12, pp. 2539-2551.

O'Flynn et al., "The Development of a Novel Miniaturized Modular Platform for Wireless Sensor Networks", Proc. The Fourth International Conference on Information Processing in Sensor Networks (ISPN'05), UCLA, Los Angeles, California, US, pp. 370-375, Apr. 24-27, 2005.

Barton et al., "Design, Fabrication and Testing of Miniaturised Wireless Inertial Measurement Units (IMU)", Electronic Components and Technology Conference 2007, pp. 1143-1148, May 29-Jun. 1, 2007.

Srinivasan et al., "Towards automatic detection of falls using wireless sensors", Proc. 29th Annual International Conference of the IEEE EMBS Cite Internationale, Lyon, France, pp. 1379-1382, Aug. 23-26, 2007.

Chung et al., "A Fusion Health Monitoring Using ECG and Accelerometer sensors for Elderly Persons at Home", Proc. 29th Annual International Conference of the IEEE EMBS Cite Internationale, Lyon, France, pp. 3818-3821, Aug. 23-26, 2007.

Lee et al., "Implementation of Accelerometer Sensor Module and Fall Detection Monitoring System based on Wireless Sensor Network", Proc. 29th Annual International Conference of the IEEE EMBS Cite Internationale, Lyon, France, pp. 2315-2318, Aug. 23-26, 2007.

Purwar et al., "Activity Monitoring from Real-Time Triaxial Accelerometer data using Sensor Network", International Conference on Control Automation and Systems 2007, in COEX, Seoul, Korea, pp. 2402, Oct. 17-20, 2007.

Hyatt, C., "Wireless Stimulus-Reflex Detection for Neonatal Monitoring", Circuits and Systems, 2007. ISCAS 2007. IEEE International Symposium, pp. 565-568, May 27-30, 2007.

Tapia et al., "Real-Time Recognition of Physical Activities and Their Intensities Using Wireless Accelerometers and a Heart Rate Monitor", Boston MA, Oct. 11-13, 2007.

International Search Report from corresponding International Application No. PCT/US2010/062626 (dated Sep. 29, 2011).

Bay, Larry; U.S. provisional patent application, U.S. Appl. No. 61/168,105 entitled "Electronic Archery Sight and Arrow," filed Apr. 9, 2009, to which each of the patents cited herein claims priority.

* cited by examiner

APPARATUS, SYSTEM AND METHOD FOR ELECTRONIC ARCHERY DEVICES

RELATED APPLICATIONS

This application claims benefit under 35 U.S.C. s. 119(e) to U.S. Provisional Application Ser. Nos. 61/293,504, entitled "HOUSING FOR ELECTRONIC ARCHERY APPARATUS," filed Jan. 8, 2010, and 61/293,757, entitled "APPARATUS, SYSTEM AND METHOD EMPLOYING ARROW FLIGHT-DATA," filed Jan. 11, 2010 which are each incorporated by reference herein in their entirety.

BACKGROUND OF INVENTION

1. Field of Invention

Embodiments of the invention generally relate to archery equipment, more specifically at least one embodiment relates to apparatus systems and methods employing an electronic apparatus in an arrow.

2. Discussion of Related Art

U.S. patent application Ser. Nos. 12/016,019 entitled SYSTEMS AND METHODS FOR ARCHERY EQUIPMENT, and 12/175,066 entitled APPARATUS, SYSTEM AND METHOD FOR ARCHERY EQUIPMENT, which are each incorporated by reference herein in their entirety, describe embodiments of electronic apparatus included in an arrow. In some of the embodiments described therein, the apparatus is included in an arrowtip, arrow shaft and/or nock. In addition, the preceding describe that wired or wireless communication can be used to transmit flight data to a base station.

SUMMARY OF INVENTION

The communication of information between an arrow-mounted device and a device external to an arrow can be accomplished by improved structure included in a communication interface. The communication interface can allow for communication of recorded flight-data from the arrow-mounted device to the device external to the arrow, and/or the communication of information such as boot code, operating software or other programs from the device external to the arrow to the arrow-mounted device. In some embodiments, the device external to the arrow includes a docking station that provides for a robust but simple to use electrical connection that can be employed in the communication interface.

According to one aspect, an apparatus is configured to couple to an arrow-mounted electronic device where the apparatus includes a housing, a receptacle included in the housing and at least one electrical contact configured to couple to a contact included in the arrow-mounted electronic device. According to one embodiment, the receptacle is configured to receive at least a portion of the arrow-mounted electronic device, the at least one electrical contact includes a spring-bias in a first direction and the spring bias is opposed with the arrow-mounted electronic device inserted within the receptacle.

According to one embodiment, the first direction is radially inward relative to a central longitudinal axis of the arrow-mounted electronic device when the electronic device is received within the receptacle. According to another embodiment, the at least one electrical contact includes a first electrical contact, the contact included in the arrow-mounted electronic device includes a first device-contact, and the apparatus includes a second electrical contact configured to couple to a second device-contact included in the arrow-mounted electronic device. According to a further embodiment, the second electrical contact is spring biased in a third direction that is substantially parallel to the first direction.

According to another aspect, the invention provides a method of making an electrical connection to an arrow-mounted electronic device, where the method includes acts of receiving at least a portion of the arrow-mounted electronic device within a housing by inserting the at least the portion of the arrow-mounted electronic device in a first direction within the housing and biasing at least one electrical contact included in the housing in a second direction to couple to a contact included in the arrow-mounted electronic device in a sliding engagement when the at least a portion of the arrow-mounted electronic device is received within the housing.

According to one embodiment, the method includes locating a receptacle in the housing to receive the at least the portion of the arrow-mounted electronic device. According to a further embodiment, the receptacle includes a mouth and the method includes determining a first distance from an exterior wall of the housing to the mouth of the receptacle as measured in a direction parallel to the second direction; and locating the mouth of the receptacle such that the first distance is greater than or equal to a second distance determined as a distance at which an end of the arrow-mounted electronic device projects from the mouth of the receptacle when the arrow-mounted electronic device is fully-received by the receptacle.

According to another aspect, an arrowtip includes a body including a cavity configured to receive at least a portion of a circuit board, a shaft attached to a proximate end of the body; and a cap configured as a distal end of the arrowtip and for removable attachment with the body. According to one embodiment, the arrowtip includes a unitary enclosed region formed when the cap is attached to the body, wherein the circuit board and a power supply are located within the unitary enclosed region.

According to a further embodiment, the arrowtip includes a power supply configured to be coupled to the circuit board, a contact configured to couple to the power supply with the arrowtip fully assembled; and a conductive resilient member configured to bias at least a portion of the power supply into engagement with the contact. In some embodiments, the arrowtip is configured such that the partial rotation of the cap moves the cap a distance in an axial direction where the distance is greater than a maximum distance by which the conductive resilient member is configured to bias the power supply.

According to yet another aspect, a configurable arrow-mounted electronic device includes electronic circuitry, a body including a proximate end and a distal end, the body configured to house at least a portion of the electronic circuitry, a shaft attached to the proximate end of the body and configured to attach to a distal end of an arrow, a first element configured as a distal end of an arrowtip, and a second element configured for attachment of an arrow point, the second element configured for removable attachment at the distal end of the body. According to one embodiment, the first element is configured for removable attachment at the distal end of the body;

According to still another aspect, the invention provides a method of employing an electronic device housing electronic circuitry in multiple configurations with an arrow where the method includes acts of attaching the electronic device at a distal end of the arrow, if the electronic device is to be configured as a field point, attaching a first element to the electronic device, the first element configured as a distal end of the field point; and if the electronic device is to be configured as an adapter, attaching a second element to the electronic device, the second element configured to receive a threaded shaft of an arrow point.

The term "arrow-mounted" as used herein refers to a device or a portion thereof that is included in an arrow when the arrow is loosed from a bow. The term "arrow-mounted" may be employed to describe any of: a device that is permanently included in the arrow, semi-permanently included in the arrow or temporarily included in the arrow. An arrow-mounted device can be included entirely in an interior region of the arrow (for example, within a hollow region of the arrow shaft), entirely external to the arrow (for example, alongside or extending from the exterior of the arrow-shaft, or include a first portion that is external to the arrow and a second portion that is internal to the arrow. Further an arrow-mounted device can be included in all or a portion of an arrow accessory such as an arrow nock or arrow point.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
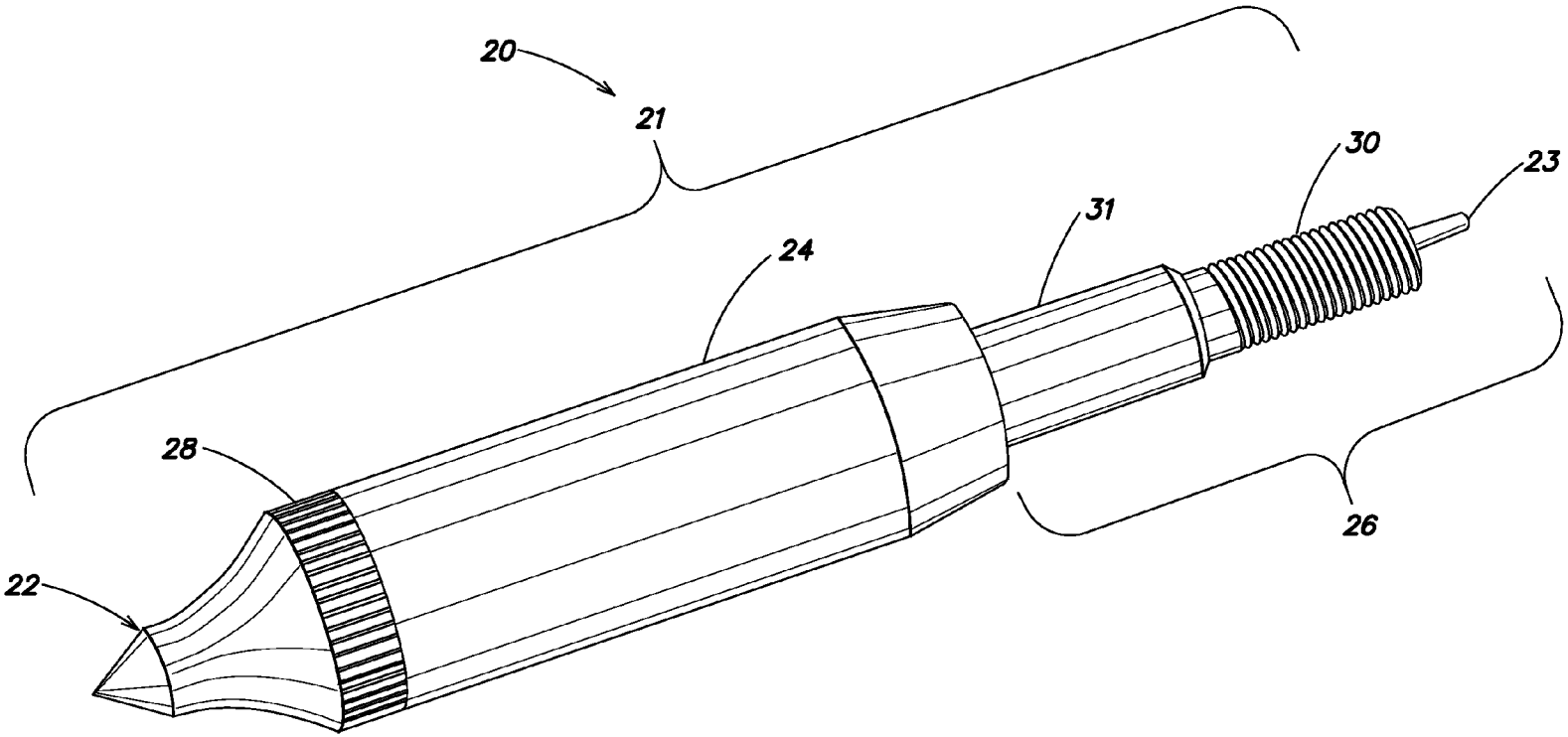
FIG. 1 illustrates an electronic device in accordance with one embodiment.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Referring to FIG. 1, an electronic device 20 is illustrated in accordance with one embodiment. According to some embodiments, the electronic device 20 is an arrow-mounted electronic device. Accordingly, in various embodiments, all a portion of the electronic device 20 can be included: in an arrow point (field point or hunting tip), in an adapter configured to receive an arrow point, in a nock, within the shaft of the arrow, or external and adjacent to the arrow shaft. The electronic device includes a cap 22, a body 24, and a shaft 26 that in accordance with one embodiment which provide a housing 21 for an electronic apparatus. According to some embodiments, the electronic device may include only the body 24 which provides the housing 21, while in another embodiment, the electronic device includes the cap 22 and the body 24 which provide the housing 21. The illustrated embodiment includes a grip 28 (for example, a knurled region) which is included in the cap 22. According to another embodiment a grip is included in the body 24 either alone or in combination with the grip 28. In addition, the housing 21 includes a threaded region 30 of the shaft 26. In the embodiment illustrated in FIG. 1, the cap 22 is configured as a distal end of a field point or target tip. Further, in accordance with some embodiments, the housing 21 attaches to the distal end of an arrow by threading the arrow to an insert. According to some embodiments, the electronic device 20 also includes a communication conductor 23 that can be employed in a hard-wired communication interface to communicate data between the electronic device 20 and an associated base station.

Figure 2:
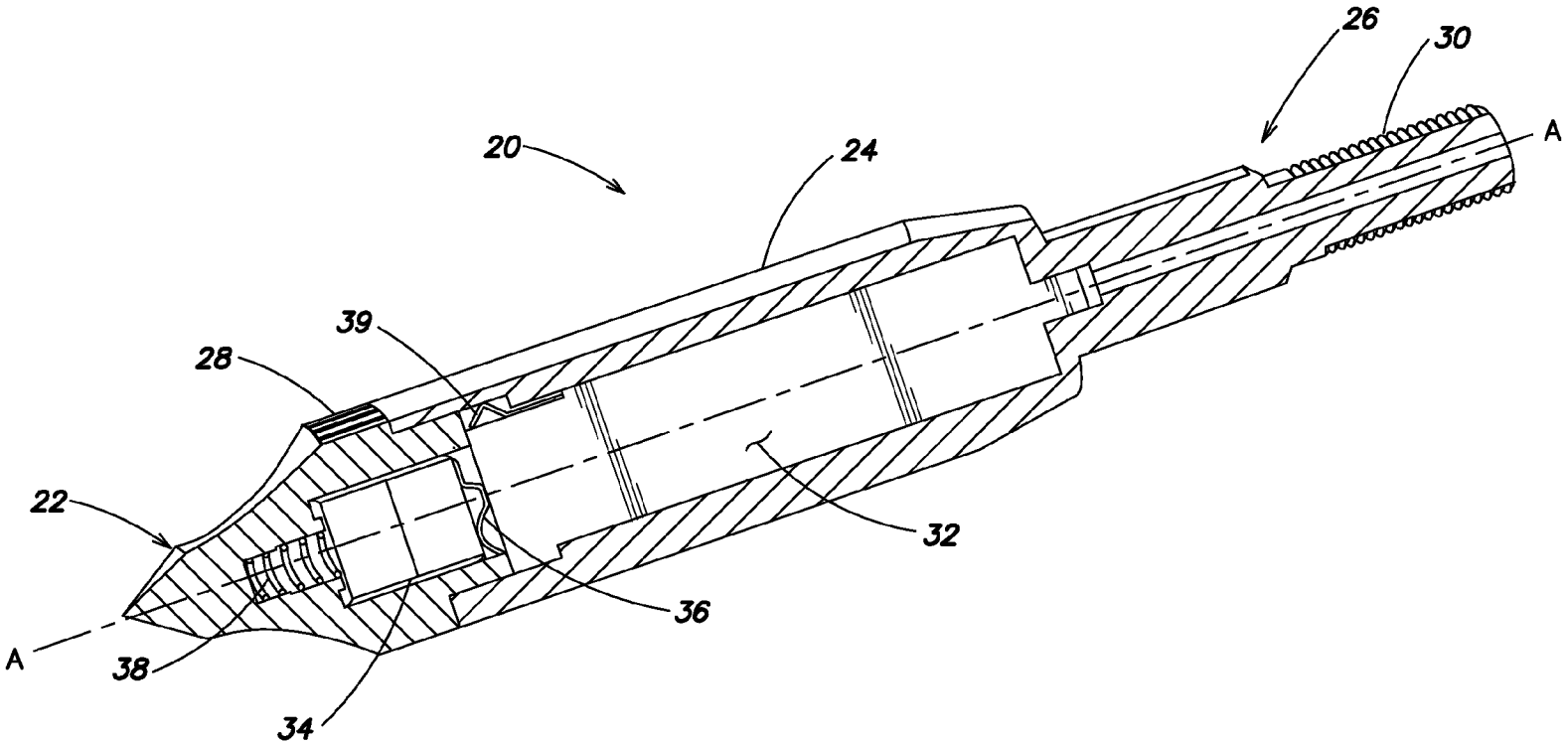
FIG. 2 illustrates a longitudinal sectional view of an electronic device in accordance with a further embodiment.

Referring now to FIG. 2, a cross-sectional view is illustrated in accordance with one embodiment of the electronic device 20. According to the illustrated embodiment, a printed circuit board 32 and a power source 34 are located in an interior of the housing 21. In the illustrated embodiment, the electronic device 20 includes a cavity in the body where the printed circuit board 32 is located. The electronic device 20 also includes a first spring contact 36, a second spring contact 38 and a third spring contact 39. In accordance with one embodiment, the first spring contact 36 is located at the distal end of the printed circuit board 32 and provides an electrical contact to connect the power source 34 to the printed circuit board 32. In one embodiment, the second spring contact 38 provides an electrical contact to connect the power source to a conductive portion of the housing 21, for example, the cap 22. In accordance with a further embodiment, the second spring contact 38 is a helical spring. In accordance with still another embodiment, the third spring contact 39 provides an electrical contact to connect the printed circuit board 32 to a conductive portion of the housing 21, for example, the body 24. In accordance with some of the preceding embodiments, a complete connection between multiple poles of the power source 34 and the printed circuit board 32 are provided by a plurality of spring contacts, for example, the spring contacts 36, 38, 39.

Figure 3A:
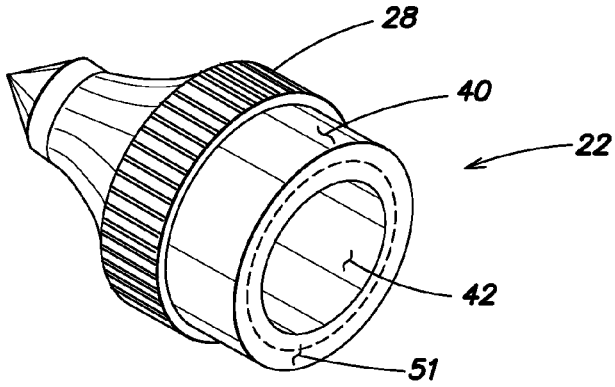
FIGS. 3A-3C illustrate a cap included in an arrow-mounted electronic device in accordance with one embodiment.

FIG. 3A provides an isometric view of the cap 22. In the illustrated embodiment, the cap includes the grip 28, a region 40 and a first cavity 42. In accordance with one embodiment, the cap 22 also includes a rim 51 that, in the illustrated embodiment, defines an opening into the cavity 42. In accordance with some embodiments, the region 40 is threaded to allow the cap 22 to be threaded to the body 24, for attachment. In accordance with an alternate embodiment, the region 40 does not include threading. For example, in some embodiments, a bayonet-style connection is employed to attach the cap 22 to the body 24. In other embodiments, the diameter of the region 40 is sized and shaped to engage a corresponding region of the body 24 to allow the cap 22 to attach to the body 24 via a friction-fit. According to another embodiment, either or both of the cap 22 and the body 24 include a resilient element to provide a friction-fit where the resilient element is spring biased.

Figure 3B:
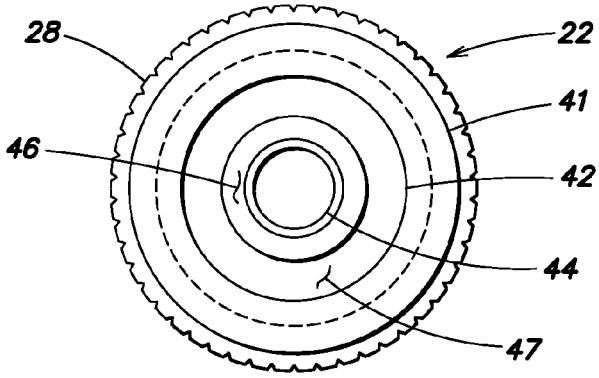
Figure 3C:
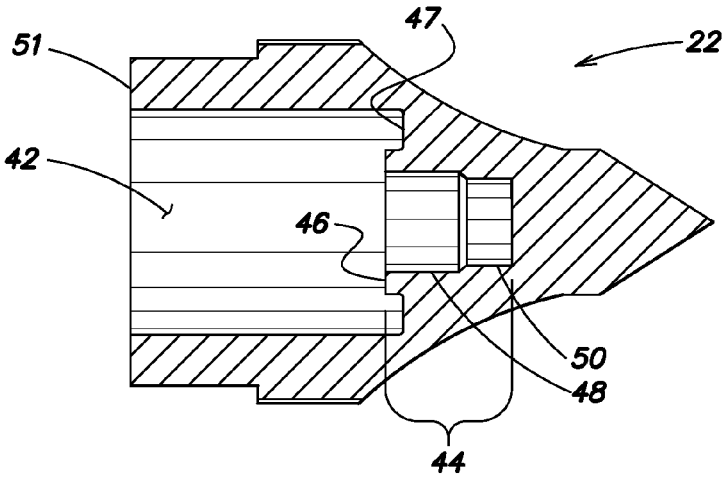

Referring now to FIG. 3B, the cap 22 is viewed from the proximate end. As illustrated in FIG. 3B, the cap includes the grip 28 and a surface 41 of the region 40. As illustrated in FIG. 3C, the cap also includes a second cavity 44. In the illustrated embodiment, the second cavity 44 includes a first region 48 and a second region 50. According to some embodiments, the first cavity 42 and the second cavity 44 are located about the central longitudinal axis. In addition, the cap 22 includes a rim 46 about the proximate end of the second cavity 44. In accordance with one embodiment, the second cavity 44 retains the second spring contact 38, for example, a helical spring. In one approach, the second region 50 has a diameter that is smaller than a diameter of the first region and is designed to securely retain the second spring contact 38 using an interference-fit. According to this embodiment, the fit is secure enough to securely retain the second spring contact 38 in place despite repeated high impact use of the electronic device 20.

In accordance with some embodiments, the rim 46 is raised relative to a region 47 that is located immediately radially outward and coaxially about the rim 46. In accordance with some embodiments, the raised construction of the rim 46 is employed to receive a first contact of a battery, for example, a coin cell battery which has a region having a first polarity. For example, where the power source 34 includes one or more coin cell batteries the batteries may be disposed within the cavity 42 in a manner in which a first region of the battery housing having a first polarity faces to the rear of the electronic device 20 and a second region having a second polarity faces toward the forward end of the electronic device 20 when retained in the cavity 42. In such an embodiment, the rim 46 allows a central region of a face of a coin cell battery having the second polarity to engage the rim 46 while preventing the first region which is located on the sidewalls, rear surface, and rim of the forward portion of the battery from making contact with the region 47, or otherwise making contact with any portion of the cap 22. According to one embodiment, the coin cell battery includes a negative pole and a positive pole.

Applicants have found that an arrow-mounted electronic device is routinely subject to forces of greater than 1000 g at launch and greater than 4000 g at impact. These high forces can lead to deformation of the housing of a coin cell battery where it is pressed against the adjacent battery-contact even where a resilient battery-contact is used. According to one embodiment, the diameter of the rim 46 is sized to be great enough to provide sufficient surface area to prevent damage to the adjacent pole of the battery. According to a further embodiment, the diameter of the rim 46 is sized to maximize the surface area in which the rim 46 contacts the adjacent pole of the battery.

Referring now to FIG. 4, an embodiment of a second portion of the electronic device 20 is illustrated where the second portion includes the body 24 and the shaft 26. In accordance with the illustrated embodiment, the body 24 includes a main cavity 25 which includes a first region 27 and a second region 29. Further, the first region 27 has a first diameter that differs from a second diameter of the region 29. In some embodiments, however the two regions may include the same diameter.

In addition, one or more slots 52 may be included in an interior side wall of the main cavity 25. In accordance with some embodiments, the slot 52 is sized and located in a side wall of the main cavity 25 so that it can receive at least a portion of the printed circuit board 32 when the printed circuit board 32 is located within the main cavity 25.

In the illustrated embodiment, the shaft 26 includes the threaded region 30, a non-threaded region 31, and a tapered portion 33. In accordance with one embodiment, the size and features of the shaft 26 conform to standards provided by the Archery Trade Association (ATA) that are employed with conforming equipment in the archery industry, for example, ATA Threaded Replacement Point System specification: ATA/ARR-204-2008. Thus, in one embodiment the threaded region 30 includes 8-32 UNC threads. In addition to the preceding, in one or more embodiments, the shaft includes a hollow region 37. In accordance with some embodiments, a communication conductor is disposed within the hollow region 37. In a further embodiment, a plurality of communication conductors are disposed within the hollow region 37. In accordance with some embodiments, the hollow region 37 is centrally located about the central longitudinal axis A. According to various, embodiments, one or more communication conductors located in the hollow region 37 are insulated, for example, to prevent contact with a conductive portion of the housing, or one another.

In a further embodiment, the electronic device 20 includes a sub-cavity 54. In accordance with some embodiments, the sub-cavity 54 is also located about the central longitudinal axis A of the electronic device 20. In the illustrated embodiment, the hollow region 37 extends from a proximate end of the electronic device 56 to the sub-cavity 54. Further the sub-cavity 54 is also connected to the main cavity 25 of the body 24. Thus, as illustrated a continuous hollow region comprising the hollow region 37, the sub-cavity 54 and the main cavity 25 is located within the electronic device 20. In one embodiment, the sub-cavity 54 is included in the shaft 26 while in an alternate embodiment, the sub-cavity 54 is included in the body 24. In yet another embodiment, a first portion of the sub-cavity 54 is included in the shaft and a second portion of the sub-cavity 54 is included in the body 24. In accordance with one embodiment, at least a portion of the wall of the second cavity 29 provides a threaded surface 58. In one embodiment, the threaded surface 58 is sized to receive and make a threaded connection with the surface 41 of the region 40 which has corresponding threads, for example, M9×1 thread. According to another embodiment, a 5/16-32 thread is used. In various embodiments, other thread sizes may be used. The diameter L of the body 24 can be established such that the diameter of the body 24 is less than or equal to the diameter of the arrow shaft with which it is used. According to other embodiments, the diameter of the body 24 (for example, the maximum diameter of the body 24) is greater than the diameter of the arrow shaft with which it is used. Accordingly, in some embodiments, the body 24 includes a beveled region 35.

Figure 4B:
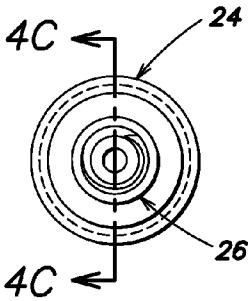
FIGS. 4A-4D illustrate a body of an electronic device in accordance with an embodiment.
Figure 4A:
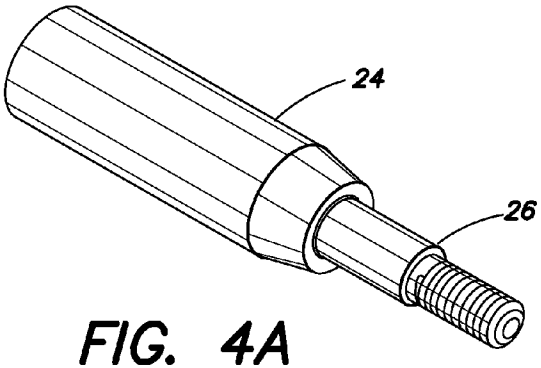
Figure 4D:
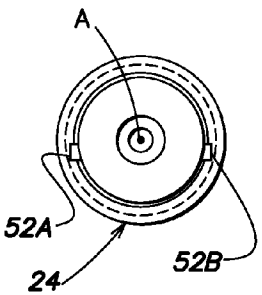
Figure 4C:
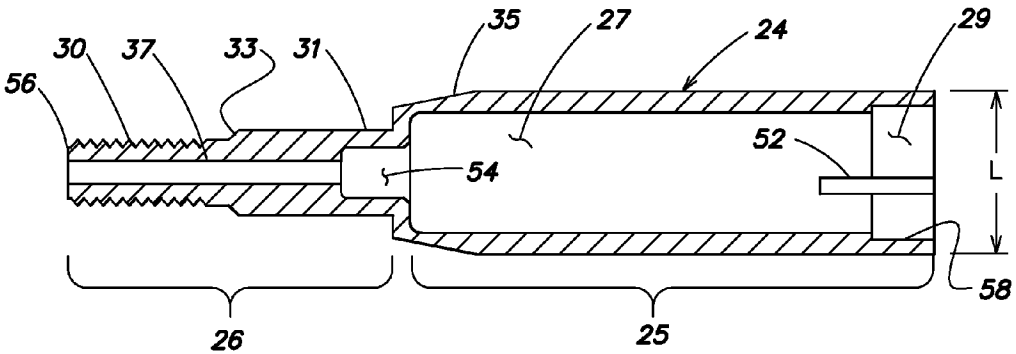

Referring now to FIG. 4D, a view of the body 24 and shaft 26 is illustrated from a distal end of the body 24. In the illustrated embodiment, the body includes a first slot 52A and a second slot 52B. According to one embodiment, the slots 52A, 52B, are aligned about the central longitudinal axis A of the electronic device. In the illustrated embodiment, however, the slots 52A and 52B are offset from a location of the central longitudinal axis A. For example, the slots 52A, 52B may be offset from the central longitudinal axis A by an amount x as illustrated in FIG. 4D. Various design considerations may be reflected in the locations selected for the slots 52A, 52B, for example, an interest in locating a center of mass of the electronic apparatus within the electronic device 20 to achieve a more stable flight, locating one or more sensors relative to the central longitudinal axis A, or alignment of a surface of the printed circuit board 32 such that a communication conductor is centrally located relative to the axis A. In these latter embodiments, an offset location of the printed circuit board 32 allows a communication pin to remain centrally located within the hollow region 37 of the shaft 36 and/or locates one or more sensors (for example, an accelerometer) at a location of the central longitudinal axis A. In one embodiment, the slots 52A, 52B are offset to locate surface mounted sensors mounted on the printed circuit board 32 on the longitudinal axis of the electronic device 20. For example, an accelerometer or other sensor or sensors can be mounted on the same side of the printed circuit board 32 where the printed circuit board is positioned within the housing 21 such that the sensor or sensors are located on the central longitudinal axis. Depending upon the embodiment, other configurations can be used. For example, instead of or in combination with the preceding, sensors can be located on both sides of the printed circuit board 21, only on a side opposite the side that aligns with the central longitudinal axis, or on either or both sides where the longitudinal axis of the PCB is centered about the longitudinal axis A (i.e., where neither side of the PCB aligns with the central longitudinal axis.

Regardless of the selected location of the slots 52A, 52B, these slots may also be employed to prevent rotation of the printed circuit board 32 within the electronic device 20. Further, regardless of the selected location, one or more of the slots 52A, 52B may be employed to provide a contact surface for the completion of an electrical connection between the body 24 of the electronic device and the printed circuit board 32. For example, one or more walls of the slots 52A, 52B may provide a contact surface that is sized and located to provide an electrical contact between the body 24 of the electronic device and the printed circuit board 32 when the printed circuit board is located in housing 21. For example, in some embodiments, the printed circuit board 32 includes respective contact surfaces configured for an interference fit with the slots 52A, 52B of the housing 21.

Referring again to FIG. 2, in accordance with some embodiments, the printed circuit board 32 is located about a central longitudinal axis of the electronic device 20. In some embodiments, the printed circuit board 32 is disposed within the main cavity 25 of the body along the central longitudinal axis A. Some or all of the other components housed in the cavities within the cap 22 and the body 24 may also be located about the central longitudinal axis A. For example, the power source 34, the first spring 36, and the second spring 38 may be centrally located about the longitudinal axis A of the electronic device 20. In accordance with other embodiments, one or more of the printed circuit board 32, the power source 34 and the second spring 38 are offset relative to the central longitudinal axis A. According to one embodiment, each of the power source 34 and the second spring 38 are located about the central longitudinal axis while the printed circuit board 32 is offset relative to the axis A. According to some embodiments, the electronic apparatus is epoxied (sometimes referred to as potted) within the housing 21. For example, the printed circuit board 32 and associated electronic components are epoxied in the main cavity 25 in accordance with one embodiment. Further, one or more conductors include in the hollow region 37 can be epoxied in place. According to one embodiment, the epoxy includes a two component epoxy, for example, MAGNOBOND 3266A/B.

According to some embodiments, the housing 21 is manufactured from a conductive material, for example, copper, aluminum, brass and other conductive materials or alloys of any of the preceding. The selection of the material for the housing 21 can result from a balance of desired characteristics including weight, mechanical strength and electrical properties. In one embodiment, the housing is manufactured from 6061 aluminum. In accordance with another embodiment, the housing is manufactured from 2024 aluminum. Aluminum can be employed because it is conductive, relatively light weight and relatively durable. In general, the housing 21 is manufactured from a material that is rigid enough and has great enough strength to be repeatedly shot into an archery target within deforming. Further, the materials of the housing 21 can be selected in consideration of any weight requirements for the electronic device 20. The housing may be manufactured to provide a total weight (including printed circuit board 32, power source 34, springs, etc.) that matches a weight of a conventional archery field point, for example, 85 grains, 95 grains, 100 grains or 125 grains. Also, as described herein, in some embodiments a conductive housing is employed to provide one or more electrical connections to the power supply and/or connection of the electronic apparatus to an external communication bus.

Figure 5:
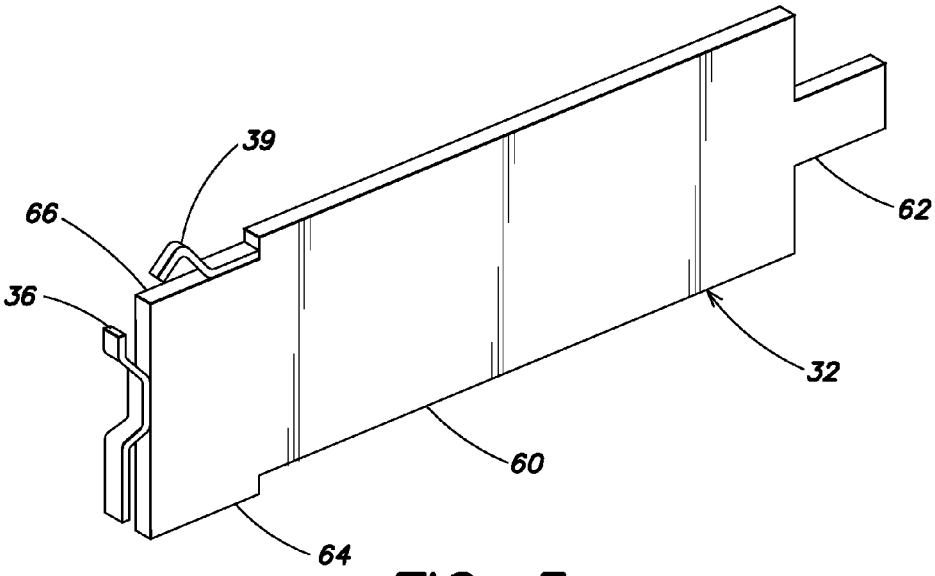
FIG. 5 illustrates a printed circuit board in accordance with one embodiment.

Referring to FIG. 5, a perspective view of an embodiment of the printed circuit board 32 is illustrated. As illustrated in FIG. 5, the printed circuit board 32 includes a main region 60 and an extension 62. In addition, the printed circuit board 32 includes an offset region 64 and a cutout 66. In accordance with the illustrated embodiment, the third spring contact 39 is located in the cutout 66 of the printed circuit board.

Figure 19:
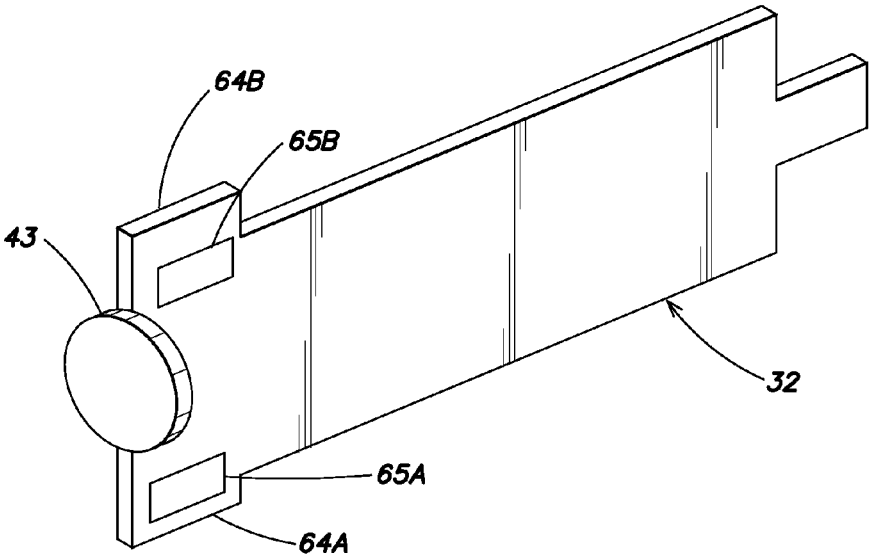
FIG. 19 illustrates a printed circuit board in accordance with one embodiment.

Applicants have found that the use of a non-resilient contact can provide for a mechanical connection suitable for the repeated high impact operation of an arrow-mounted electronic device. In addition, a non-resilient contact can reduce the depth of the contact, in a direction along the longitudinal axis of the electronic device 20, because the contact does not require any depth for travel of a portion of the contact because the contact is rigid. This can allow the overall length of the housing 21 to be reduced by a corresponding amount. Referring to FIG. 19, a perspective view of another embodiment of the printed circuit board 32 is illustrated in which a non-resilient contact 43 is employed. Such an approach can also provide an increased contact surface area for contact with an adjacent coin cell battery when the electronic device 20 is assembled.

Figure 20A:
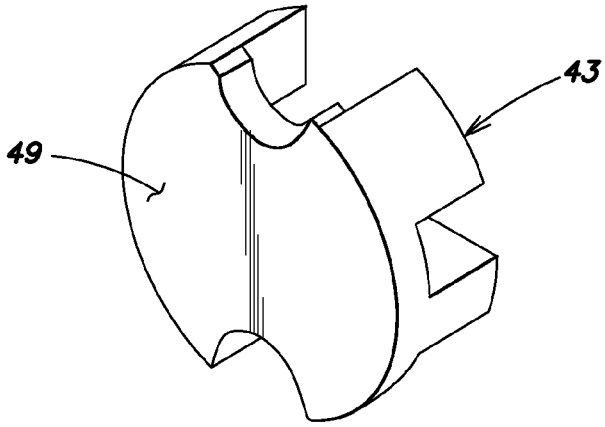
FIGS. 20A-20C illustrate an electrical contact in accordance with one embodiment.
Figure 20B:
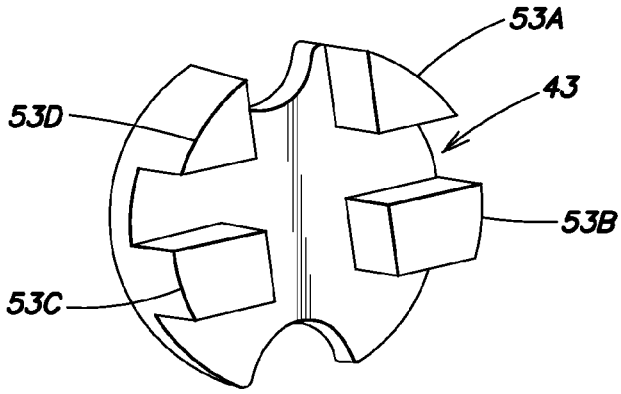
Figure 20C:
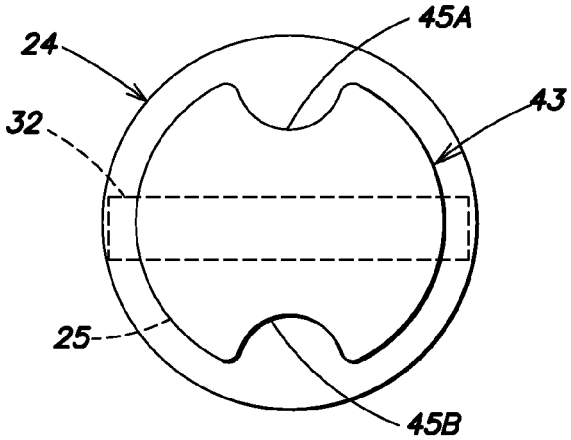

An embodiment of the contact 43 is illustrated in FIGS. 20-20C. The contact 43 includes regions 45A, 45B, a contact surface 49 and flanges 53A-53D. FIG. 20C illustrates the contact 43 attached at the distal end of the printed circuit board 32 with the printed circuit board located within the main cavity 25 of the body 24. According to the illustrated embodiment, the flanges 53A-53B are soldered to the printed circuit board 32 where the flanges 53A and 53D are soldered to a first side of the printed circuit board 32 and the flanges 53B and 53C are soldered to a second side of the printed circuit board. In addition, in some embodiments, epoxy is inserted within the main cavity on either side of the printed circuit board 32 to increase the mechanical integrity of the electronic device 20 and to prevent the printed circuit board and associated components from being exposed to moisture or other contaminants. According to these embodiments, the contact 43 can be equipped with regions 45A, 45B that are sized and shaped to allow insertion of a tip of a syringe which is used to dispense the epoxy in the main cavity 25. In accordance with one embodiment, the diameter of the surface 49 is sized to be great enough to provide sufficient surface area to prevent damage to the adjacent pole of the battery which would otherwise result from the repeated acceleration and deceleration forces that the electronic device 20 is subject to when included in an arrow.

Applicants have found that the relatively small form factor required of an arrow mounted electronic device can be achieved with one or more approaches used to configure the electronic device 20. For example, in accordance with one embodiment, the printed circuit board 32 is a multi layer printed circuit board. This approach can reduce the overall surface area required by the printed circuit board 32 because circuits can be routed via three or more layers instead of only the top and the bottom layers found in prior devices. In addition, devices are located (i.e., populated) on each of the top layer and the bottom layer of a circuit board that includes three or more layers. According to one embodiment, the printed circuit board 32 is a four layer printed circuit board that includes devices which are surface mounted on each of the two planar sides of printed circuit board 32. In yet a further embodiment, the printed circuit board 32 includes copper tracings on each side. According to one embodiment, the printed circuit board material is FR 4. In a further embodiment, the printed circuit board has a total thickness of between 0.7 and 0.9 mm However, other types of circuit boards and circuit board construction can be employed in various embodiments.

In accordance with some embodiments, the printed circuit board 32 includes both passive components and active components such as integrated circuits. The passive components in various embodiments may include any of resistors, capacitors, and/or inductors. According to various embodiments, the active components may include, for example, any of processors, microcontrollers, accelerometers and/or shock sensors either alone or in combination with one another and/or other active components.

As described above, in some embodiments, the printed circuit board 32 includes contacts configured to provide an interference-fit with one or more regions of the housing 21, for example, the slots 52A, 52B. In some embodiments, the offset region 64 includes a solder pad that provides a contact on the printed circuit board such that the solder pad securely engages the interior of the corresponding slot to create an electrical connection. For example, referring to FIG. 19, the printed circuit board 32 includes offset regions 64A, 64B that each includes solder pads 65A, 65B, respectively. Applicants have found that the relative softness of solder is advantageous for use in such an interference-fit, in particular, where the housing 21 is manufactured from a harder material such as aluminum or steel.

Figure 6:
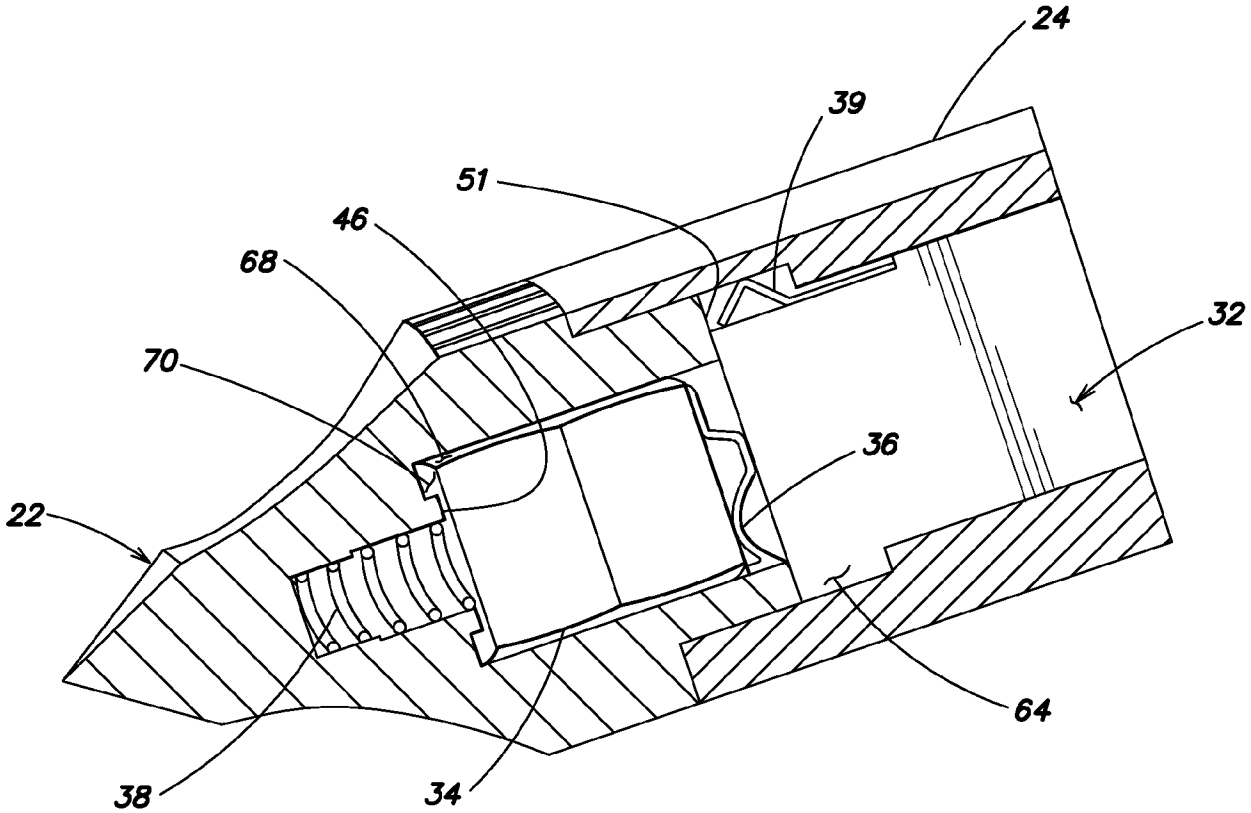
FIG. 6 illustrates a sectional view of a portion of the electronic device of FIG. 2 in accordance with one embodiment.

Referring now to FIG. 6, a close-up view of a portion of the electronic device 20 is illustrated. In the illustrated embodiment, the electronic device 20 includes the body 24, the cap 22, the printed circuit board 32, the power source 34, the first spring contact 36, the second spring contact 38 and the third spring contact 39. According to one embodiment, operating power for the electronic device electronics is supplied from the power source 34 to the printed circuit board 32 at least in part by the conductive cap 22 and/or body 24 of the housing 29. As mentioned above, the offset region 64 of the printed circuit board may provide an electrical connection between the body 24 and the printed circuit board 32, for example, the offset region 64 may include a contact surface on either or both planar sides of the printed circuit boards that engage one or more walls of the slot 52 of the conductive housing 21. Further, although a variety of power sources may be employed, in the illustrated embodiment, the power source 34 includes a plurality of coin cell batteries. In a further embodiment, only a single coin cell battery is included while in yet a further embodiment, three or more coin cell batteries are included in a power source 34.

FIG. 6 illustrates a first region 68 of the coin cell battery that includes a first pole having a positive polarity and a second region 70 of the battery that includes a second pole having a second polarity. In one embodiment, the first region 68 has a positive polarity and the second region 70 has a second polarity which is negative. As is illustrated in FIG. 6, the rim 46 having a raised configuration provides a contact surface for the second region of the power source of the coin cell battery while also preventing contact between the first region 68 and the distal end of the first cavity 42. Thus, in the illustrated embodiment, the housing 21 provides a conductive path from the second region 70 of a coin cell battery to the printed circuit board, for example, via the walls of the slots 52A, 52B and/or the third spring 39. In a further embodiment, the first cavity 48 includes a sleeve or some form of insulation between the outer walls of the coin cell batteries, i.e., the first region 68 of the batteries, and the housing 21. In accordance with one embodiment, the power source 34 includes at least one coin cell battery encased in heat shrink material for at least the outer diameter of batteries. An electrical connection between the first region 68 and the printed circuit board is provided via the first spring 36 which connects the first region 68 to the distal end of the printed circuit board 32. In accordance with one embodiment, the first spring contact 36 is not included. Instead, a non-resilient contact is connected at the distal end of the printed circuit board 32, as described concerning FIG. 19.

Figure 14A:
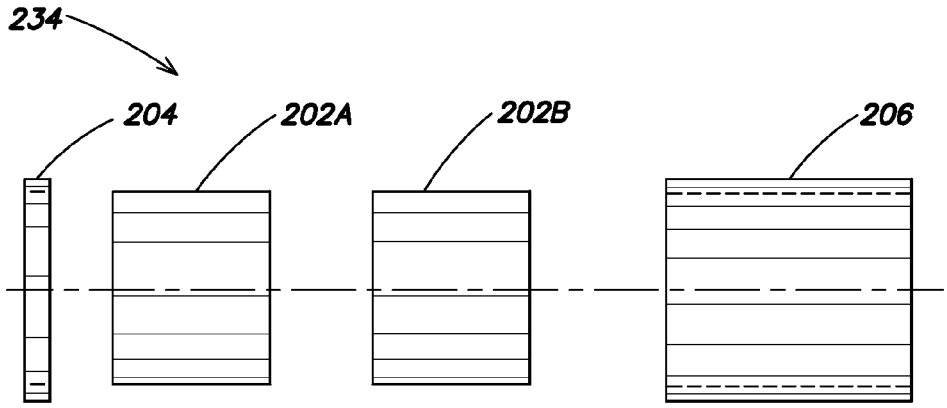
FIGS. 14A-14C illustrate a power source in accordance with one embodiment.
Figure 14B:
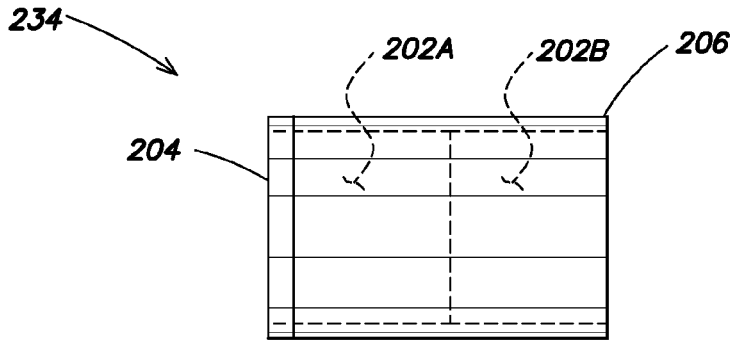
Figure 14C:
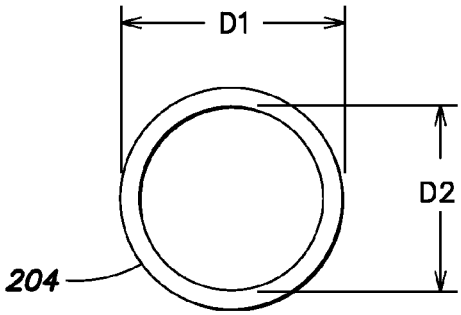

Referring now to FIGS. 14A-14C, a power source 234 is illustrated in accordance with a further embodiment. The power source 234 includes a plurality of coin cell batteries 202A, 202B, a non-conductive resilient member and an insulating sleeve 206. According to one embodiment, the power source 234 includes a single coin cell battery. In further embodiments, the power source 234 can include various other types of batteries provided that they have a form factor suitable for inclusion in an arrow-mounted device.

The high forces that occur when an arrow is launched and when the arrow impacts a target can act to temporarily disconnect the electrical connection between the printed circuit board 32 and the power source included in the electronic device 20. The duration of such interruptions can vary depending upon the force of any resilient contacts employed in the device, the mass of the power source and the rate of acceleration or deceleration of the arrow in which the electronic device is employed. Although additional capacitance provided in the electronic device can act to maintain operational power during temporary interruptions, the added capacitance may not be sufficient to prevent the physical disconnection of the power source from creating unreliable operation of the electronic device. Thus, the reliability of the electronic device 20 can be improved by minimizing the movement of the power source to minimize the duration of any temporary loss of connection with the power source. According to the illustrated embodiment, the non-conductive resilient member 204 acts to limit the travel of the power source 234. In various embodiments, the power source 234 can include the non-conductive resilient member 204 located at the distal end of power source 234, the proximate end of the power source 234 or at each of the distal and proximate ends of the power source. For example, where the non-conductive resilient member 204 is located at the distal end of the power source 234, the travel of the power source is limited on impact. Conversely, where the non-conductive resilient member 204 is located at the proximate end of the power source 234, the travel of the power source is limited on launch of the arrow from the bow.

According to some embodiments, the non-conductive resilient member 204 includes an o-ring. According to other embodiments, alternate configurations of the non-conductive resilient member 204 can be employed provided that the outside diameter is suitable for inclusion in the electronic device 20 and that a region is provided to allow electrical contact to the coin cell batteries 202A, 202B. For example in one embodiment, an o-ring is employed with an electronic device 20 that includes a helical-spring style second spring contact 38. According to this embodiment, the inside diameter of the o-ring is greater than the outside diameter of the helical-style spring to allow the second spring contact 38 to fit within the o-ring and make contact with the adjacent pole of the coin cell battery. In addition, the outside diameter of the o-ring is substantially equal to the outside diameter of the coin cell batteries 202. According to one embodiment, the non-conductive resilient member 204 is manufactured from nitrile rubber, also referred to as Buna-n.

According to some embodiments, the insulating sleeve 206 encloses the radially outside surfaces of at least the coin cell batteries 202 to prevent those surfaces from contacting a conductive portion of the housing 21 when the power source 234 is included in the electronic device 20. In accordance with one embodiment, the insulating sleeve includes a heat shrink tubing to securely retain the coin cell batteries 202 while maintaining the batteries 202 in a fixed position relative to one another. In a further embodiment, the non-conductive resilient member 206 is also securely retained within the insulating sleeve 206 to maintain the non-conductive resilient member 206 in a fixed position relative to the batteries 202. According to one embodiment, the insulating sleeve 206 includes a wall thickness of 0.00100 inches, for example, as provided by ADVANCED POLYMERS Type 250100.

As used herein, the term "non-conductive" refers to a material that prevents the flow of current when employed with a power source that provides a known range of output voltage. It should be apparent, that a non-conductive material acts as an insulator with the selected power source. Accordingly, in another application, where the material is exposed to an increased voltage, the material may not act as an insulator.

In accordance with another embodiment, the travel of the power source 234 at launch or impact can be limited by the use of a compressible and resilient electrically conductive pad (also referred to as a "sponge contact"), for example, a GORE-SHIELD pad as manufactured by W.L. GORE. According to one embodiment, the compressible and resilient electrically conductive pad is soldered to the contact surface 49 of the contact 43. In some embodiments, the compressible and resilient electrically conductive pad includes a polymer-based conductor, for example, polytetrafluoroethylene blended with conductive material.

FIG. 6 also illustrates an embodiment where the size and shape of the cap 22 can limit the forward axial movement of the printed circuit board when the electronic device is in use. For example, in the illustrated embodiment, the rim 51 abuts a distal end of the printed circuit board when the cap 22 is fully threaded to the body 24 to complete assembly of the electronic device 20. According to this embodiment, the immediately adjacent location of the rim 51 of the cap 22 limits the forward axial movement of the printed circuit board during use of the electronic device 20. This can be used to prevent the full compression of the second spring contact 38. According to one embodiment, however, the diameter of the rim 51 is greater than the diameter of the body 24 such that the distal end of the body is received within the cap 22. According to this embodiment, threads are located on an inside wall of the first cavity 41.

Figure 7:
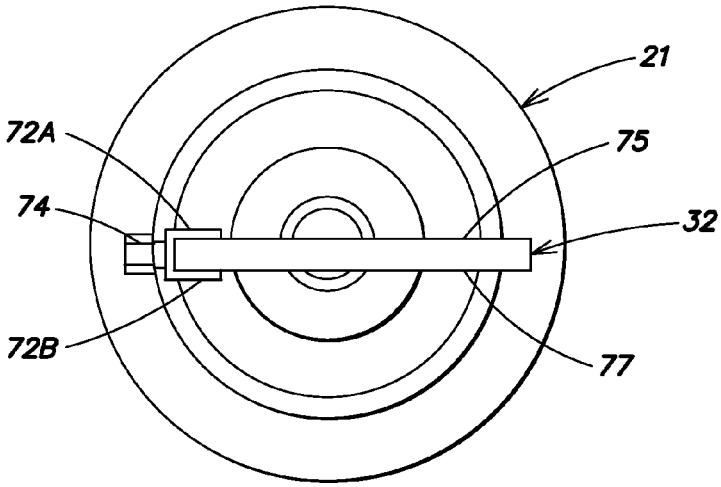
FIG. 7 illustrates a cross-sectional view of an electronic device with a printed circuit board housed within the electronic device in accordance with one embodiment.

According to the embodiment, the first spring contact 36 and the second spring contact 39 can be attached to the printed circuit board 32 via various means. Referring now to FIG. 7, in accordance with one embodiment, the springs include at least one flange which can be soldered to a surface of the printed circuit board. In FIG. 7, the printed circuit board 32 is illustrated located within the electronic device housing 21 where the printed circuit board 32 includes a first planar side 75 and a second planar side 77. FIG. 7 also illustrates an embodiment of the third spring 39 including a first flange 72A and a second flange 72B as well as a resilient member 74. In the illustrated embodiment, the first flange and the second flange are each soldered to the printed circuit board, for example, to a contact pad located on opposing surfaces of the printed circuit board. Further, the resilient member 74 engages the body 24 and applies a force that is generally directed in a radial outward direction relative to the central longitudinal axis A.

Figure 8:
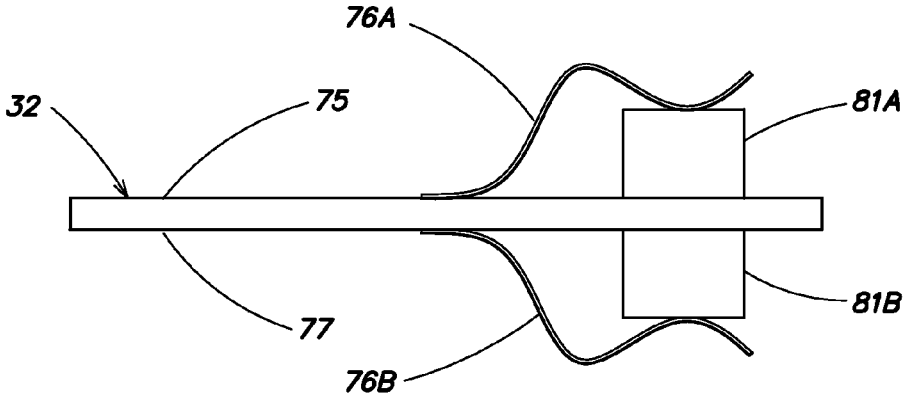
FIG. 8 illustrates a printed circuit board in accordance with another embodiment.

According to other embodiments, the printed circuit board 32 and electronic-device housing 21 may include additional or different features alone or in combination with the preceding. For example, referring now to FIG. 8, the printed circuit board can include one or more batteries that are secured directly to either or both planar surfaces 75, 77 of the printed circuit board 32. FIG. 8 illustrates an embodiment that includes a plurality of batteries, for example, coin cell batteries that are employed as the power source 34 where the batteries are secured to the printed circuit board 32 via one or more spring contacts 76. According to the illustrated embodiment, the batteries are slid beneath the spring contacts 76A, 76B, respectively, and secured by pressure provided by the corresponding spring contact to the printed circuit board 32. For example, as illustrated, a first spring contact 76A retains a first battery 81A against the first planar surface 75 and a second spring contact 76B retains a second battery 81B against the second planar surface 77. An electrical connection between one of either the first region 68 and the second region 70 of each battery 81A, 81B is provided by the spring contact and the second electrical connection to the printed circuit board is completed on a contact surface located beneath the battery on the planar face of the printed circuit board 32. According to one embodiment, the spring contacts 76A, 76B are manufactured from sheet metal.

Figure 9:
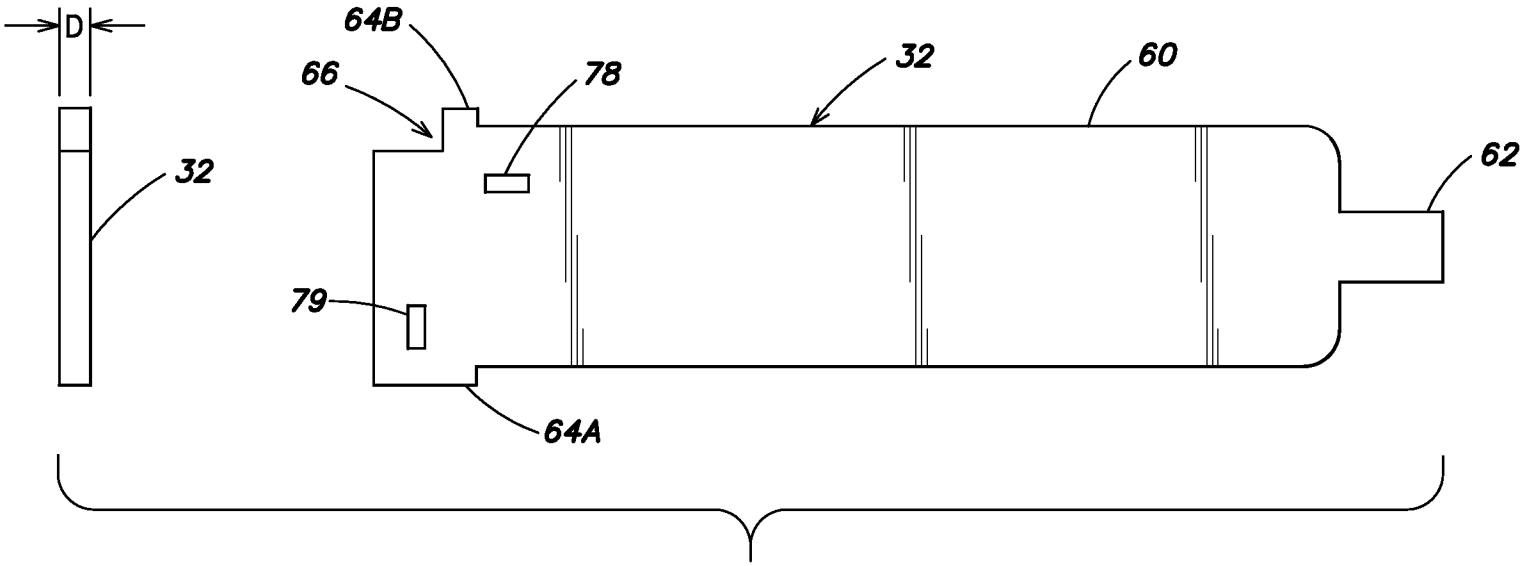
FIG. 9 illustrates a printed circuit board in still another embodiment.

Referring now to FIG. 9, a further printed circuit board design is illustrated. According to this embodiment, the printed circuit board includes the main region 60, the extension 62, a first offset region 64A, a second offset region 64B, and a cutout 66. According to a further embodiment, the printed circuit board can include a first slot 78 and a second slot 79. In the illustrated embodiment, each of the first offset region 64A and the second offset region 64B extend from the main body 60 of the printed circuit board 32 and can engage one or more slots 52A, 52B located in the electronic-device housing 21. Further, either or both offset 64A, 64B can include contact surfaces and have a thickness that allows them to engage and make an electrical contact with one or more walls of the slots 52A, 52B. For example, in the illustrated embodiment, the printed circuit board has a thickness D of substantially 0.85 mm, however, other thicknesses may be employed provided they allow the offset region 64A, 64B to slidingly engage in the slots 52A, 52B of the electronic-device housing 21. Each of the first slot 78 and the second slot 79 may accommodate a portion of a wire spring which may be employed to provide contact for electrical connection between either or both of the printed circuit board and the electronic-device housing 21 and the printed circuit board and the power source 34.

Figure 10:
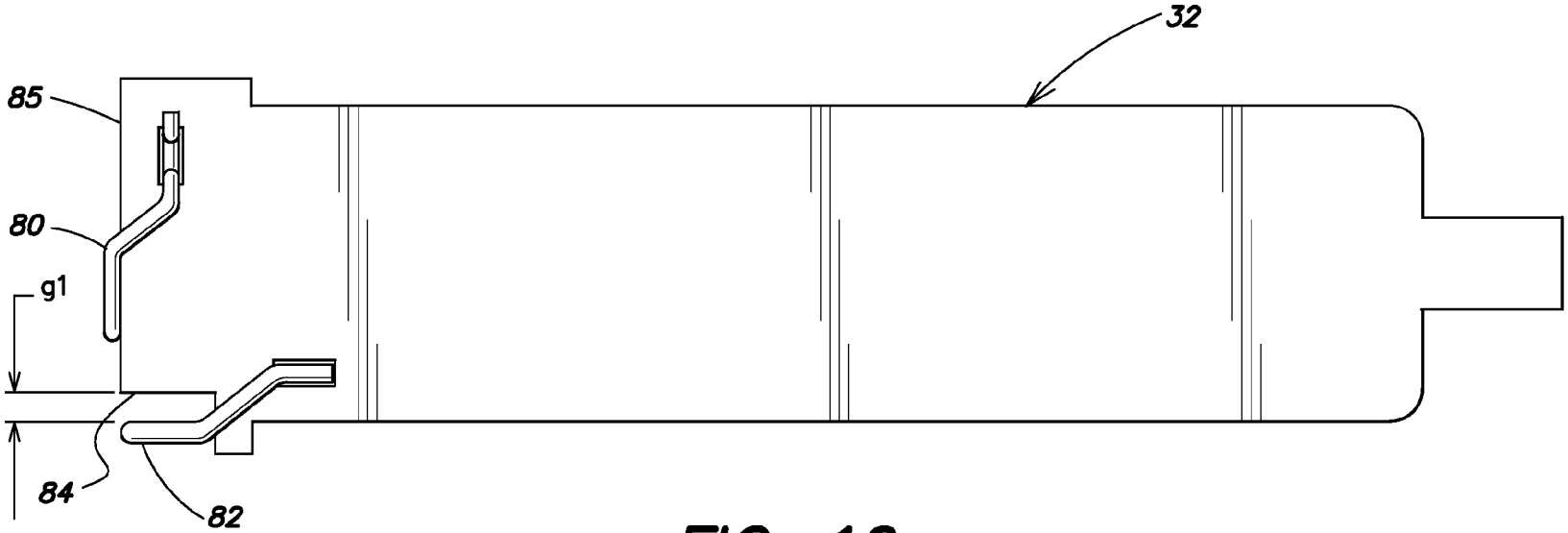
FIG. 10 illustrates the printed circuit board of FIG. 9 including contacts according to one embodiment.

Referring now to FIG. 10, the printed circuit board of FIG. 9 is further illustrated. In FIG. 10, a first wire spring contact 80 and a second wire spring contact 82 are attached to the printed circuit board 32. The wire springs can be manufactured from any of a variety of conductive material depending upon the embodiment, provide that it can be configured for inclusion in the electronic device and provide a resilient element to assist in maintaining an electrical connection. According to one embodiment, the wire spring contacts are manufactured from phosphor bronze while in another embodiment they are manufactured from nickel coated material, for example, nickel plated stainless steel.

According to some embodiments, a gap g1 exists between an edge or a face of the circuit board 32 and the wire spring contact to allow a deflection of the wire spring contact when a load is applied. Further, in one embodiment, a gap exists between the first edge 84 of the circuit board 32 and the second wire spring contact 82, and between the second edge 85 of the circuit board 32 and the first wire spring 80.

Figure 15:
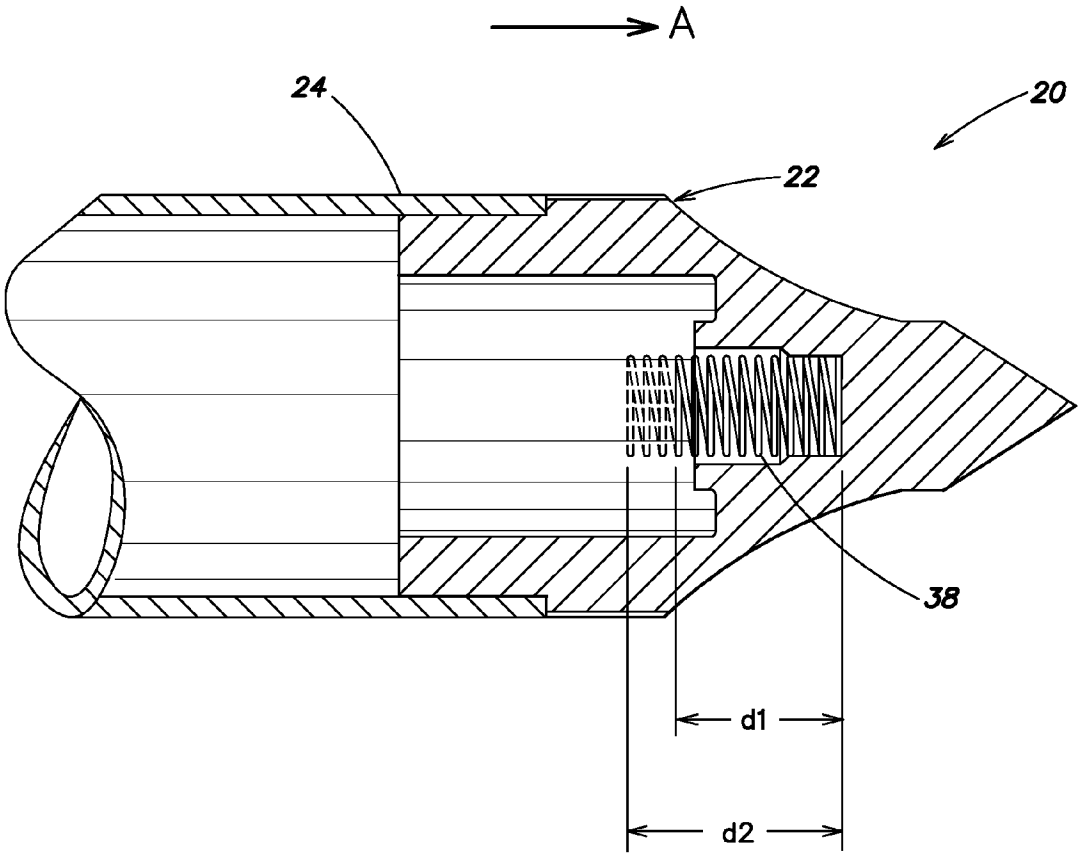
FIG. 15 illustrates an electronic device in accordance with one embodiment.

The relatively small form factor and robust design required of an arrow-mounted electronic device generally also limit the suitability of switches or other approaches for turning power on and off to the electronic device 20. Referring now to FIG. 15, an embodiment is illustrated in which the dimensions of various components included in the electronic device 20 are selected to allow the device to be turned on and off in a straightforward manner. For example, where the cap 22 is attached to the body 24 using threads the rotation of the cap relative to the body can be employed to effectively disconnect the power source by a partial unthreading of the cap from the body without fully separating the cap 22 from the body 24. Such an approach can be advantageous because it does not require any electronic component (such as a switch) to cycle power to the electronic device 20. The preceding approach can lower costs and increase reliability because a separate component is not required to turn the electronic device 20 on and off. In addition, the power source does not need to be removed from the electronic device 20 to turn the power off. Thus, the risk of misplacing a removable power source or separating the cap 22 from the body 24 is also greatly reduced.

According to some embodiments, the preceding is achieved where a distance of the axial travel (direction A in FIG. 15) of the cap caused by the partial unthreading is greater than the distance by which the second spring contact 38 travels from the point at which it is compressed with the electronic device 20 fully assembled to the point at which it is fully relaxed. As illustrated in FIG. 15, the second spring contact 38 is illustrated in a compressed state with a length equal to d1, and also illustrated in phantom in an uncompressed state with a length equal to d2. According to this embodiment, the travel (change in length) of the second spring contact 38 from the compressed state to the uncompressed state equals d2 minus d1. According to one embodiment, the above-described on/off operation of the electronic device 20 is achieved where the axial distance traveled by the cap for a partial unthreading of the cap from the body is greater than d2 minus d1.

Figure 16A:
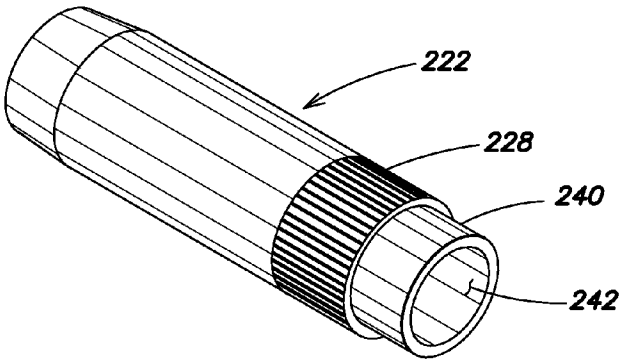
FIGS. 16A-16C illustrate an adapter for use with an electronic device in accordance with one embodiment.
Figure 16C:
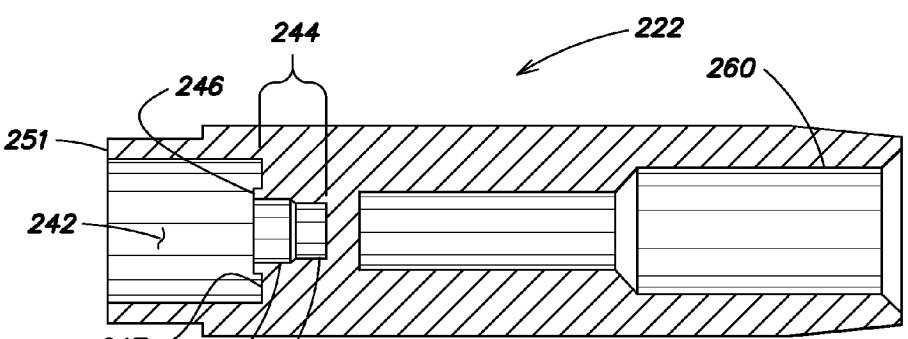
Figure 16B:
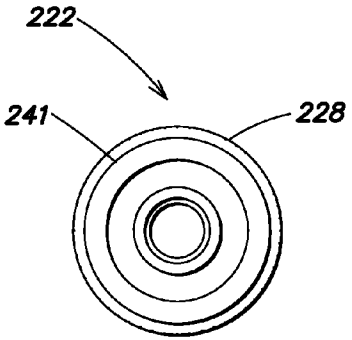

Referring now to FIGS. 16A-16C, another cap 222 that can be included in the electronic device 20 is illustrated in accordance with another embodiment. According to the illustrated embodiment, the cap 222 includes an adapter region 260 that allows various arrow points to be attached to the distal end of the electronic device 20. FIG. 16A provides an isometric view of the cap 222. In the illustrated embodiment, the cap includes the grip 228, a region 240 and a first cavity 242. In accordance with one embodiment, the cap 222 also includes a rim 251 that, in the illustrated embodiment, defines an opening into the cavity 242. In accordance with some embodiments, the region 240 is threaded to allow the cap 222 to be threaded to the body 24.

Referring now to FIG. 16B, the cap 222 is viewed from the proximate end. As illustrated in FIG. 16B, the cap includes the grip 228 and a surface 241 of the region 240. As illustrated in FIG. 16C, the cap also includes a second cavity 244. In the illustrated embodiment, the second cavity 244 includes a first region 248 and a second region 250. According to some embodiments, the first cavity 242 and the second cavity 244 are located about the central longitudinal axis. In addition, the cap 222 includes a rim 246 about the proximate end of the second cavity 244. In accordance with one embodiment, the second cavity 244 retains the second spring contact 38, for example, a helical spring. In one approach, the second region 250 has a diameter that is smaller than a diameter of the first region and is designed to securely retain the second spring contact 238 using an interference-fit. In accordance with some embodiments, the rim 246 is raised relative to a region 247 that is located immediately radially outward and coaxially about the rim 246.

Figure 17A:
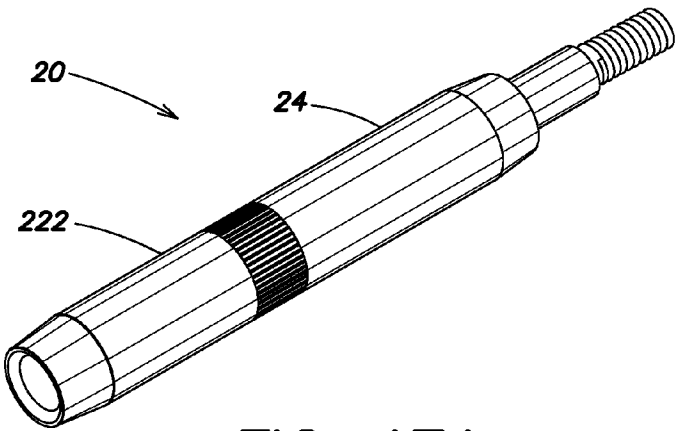
FIGS. 17A-17C illustrate an electronic device in accordance with one embodiment.
Figure 17C:
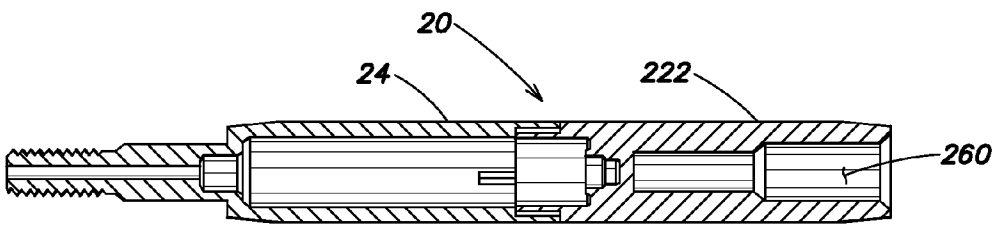
Figure 17B:
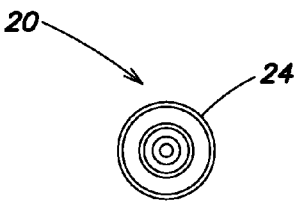

Further, according to the illustrated embodiment, the adapter region 260 includes an interior that provides dimensions and features conforming to standards provided by the Archery Trade Association (ATA) that are employed with conforming equipment in the archery industry. For example, the adapter region 260 can be configured to receive any arrow point that complies with the ATA Threaded Replacement Point System specification: ATA/ARR-204-2008. As a result, the electronic device 20 including the cap 222 can be attached to the distal end of an arrow. With the cap 222 attached, various style arrow points can be tested including bodkin, broadhead, blunt, Judo, field point, fish point and target heads (or field points). This functionality can be useful in using the electronic device 20 to collect flight-data for the various arrow-point configurations for comparison and evaluation. According to one embodiment, the cap 22 and the cap 222 are configured such that they can be used interchangeably with the body 24 included in the electronic device 20. Referring now to FIGS. 17A-17C, the electronic device 20 is illustrated with the cap 222 attached to the distal end of the body 24.

Figure 11:
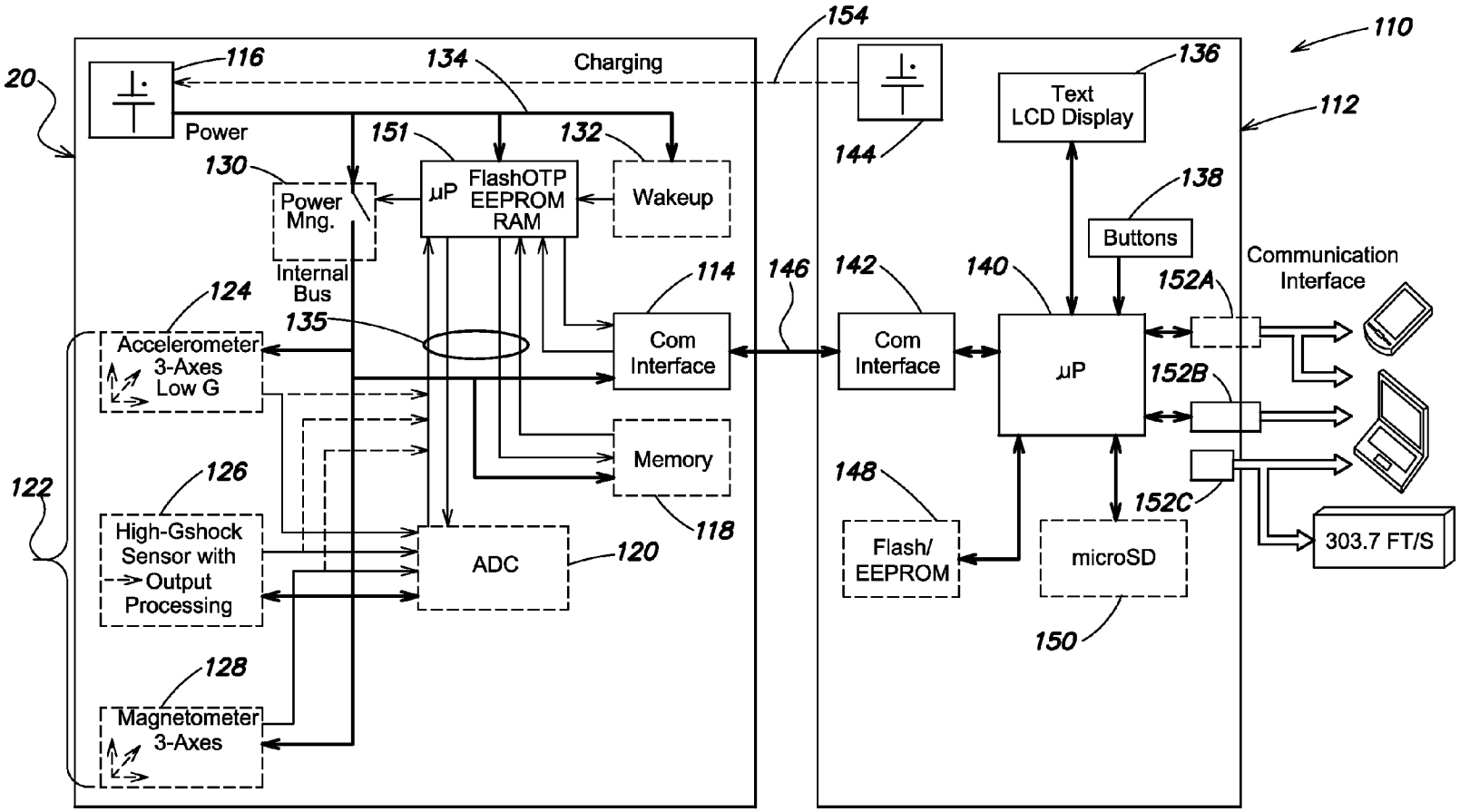
FIG. 11 illustrates a system including an electronic device in accordance with one embodiment.

Referring to FIG. 11, a system 110 includes the electronic device 20 and a base station 112. In accordance with the illustrated embodiment, the electronic device 20 includes a microcontroller 151, a communication interface 114, and a power source 116. According to various embodiments, the power source may include a replaceable battery, and/or a rechargeable battery. In an alternate embodiment, the power source 116 may include a super capacitor. The electronic device 20 illustrated in FIG. 11 may also include one or more additional components, circuitry and/or functionality as illustrated in phantom. For example, in some embodiments, the electronic device 20 includes a memory 118 that is external to the microcontroller 151. In accordance with a further embodiment, the electronic apparatus can include an analog-to-digital converter (ADC) 120. Further, according to various embodiments, the electronic device 20 includes one or more sensors 122 which may include, depending upon the application, multi-axis accelerometer 124, a shock sensor 126, a magnetometer 128 and a gyroscope.

In addition to or in combination with the preceding, the electronic apparatus may also include power management circuitry or device 130 that can include hardware to isolate the power source 116 to prevent operation of the device and/or draining of power from the power source when the electronic device 20 is not in use. Further, the electronic device 20 can include device activation circuitry and/or devices 132 that operate to place the electronic device 20 into an active state at or prior to a release of the arrow from the bow. As illustrated, the various components may be supplied power via a power bus 134. Further, an internal communication bus 135 may be employed to allow the various devices and/or circuitry included in the electronic device 20 to communicate with one another. For example, data from the sensors may be communicated to any of the microcontroller 151, memory 118, and/or ADC 120.

According to one embodiment, the communication bus 135 includes an $I^2C$ communication bus. According to a further embodiment, the communication bus 135 is configured such that the microcontroller 151 is the master while other connected devices are slaves (for examples, memory 118, any of the plurality of sensors 122, etc.). According to another embodiment, the communication bus 135 is a serial peripheral interface bus (SPI).

In the illustrated embodiment, the base station includes a display 136, an operator interface 138, a microprocessor 140, a communication interface 142 and a power source 144. In accordance with one embodiment, the display 136 is an LCD text display while in an alternate embodiment the display 136 is a graphical LCD display. The operator interface can include one or more push buttons or keys and according to some embodiments can be included with the display 136 as a single operator interface. The microprocessor 140 in some embodiments may be included in a microcontroller.

Where hardware communication is employed, a communication bus 146 can be used provide hardware communication interface between the electronic device 20 and the base station 112. According to some embodiments, the external communication bus is a serial bus, for example, a single wire serial communication bus. Further, where a hardwired communication bus is employed the base station 112 can include a connector configured to complete an electrical connection with one or more communication pins included in the electronic device 20, for example, the communication pin 23.

In accordance with some embodiments, the base station 112 includes a first memory 148 and a second memory 150. According to one embodiment, the first memory is permanently located in the base station 112 while the second memory is a removable memory, for example, a removable flash memory such as in the micro SD format or other types of flash memory cards. Other forms of memory may be used for either of the first memory or the second memory. According to some embodiments, the first memory 148 is a flash memory while in other embodiments the first memory 148 is EEPROM memory. In yet a further embodiment, the base station 112 includes each of flash memory and EEPROM memory.

According to some embodiments, the base station 112 includes a communication interface 152 that allows the base station to communicate with an external device such as a computer or a personal digital assistant (PDA). In some embodiments, the communication interface 152 includes one or more of a USB port 152A or other hardware serial communication and one or more wireless communication interfaces 152B such as a BLUETOOTH communication interface or a Wi-Fi communication interface for communication between the base station 112 and an external device such as a computer, mobile phone, IPHONE, PDA or local display.

Further where the electronic apparatus includes a power source 116 that is rechargeable recharging circuitry may connect the electronic apparatus to the base station 112 to provide recharging of the power source 116 included in the electronic device 20. Thus, for example, connection of the electronic device 20 to the base station 112 may allow the base station 112 to provide power to recharge the power source 116 (such as batteries) included in the electronic device 20.

According to some embodiments, the external communication between the electronic device 20 and the base station 112 is wireless. Accordingly, in some embodiments, the electronic apparatus includes a wireless transmitter and the base station 112 includes a wireless receiver. Further, where bidirectional communication is desired, each of the electronic device 20 and the base station 112 can include a wireless transceiver that allows communication between the device 20 and the base station 112.

According to some embodiments, the base station 112 is provided in the form of a docking station that allows hardwire communication between the electronic device 20 and the base station 112. For example, the electronic apparatus may be plugged into or otherwise physically connected to a base station 112 which is in the form of a docking station.

Figure 12:
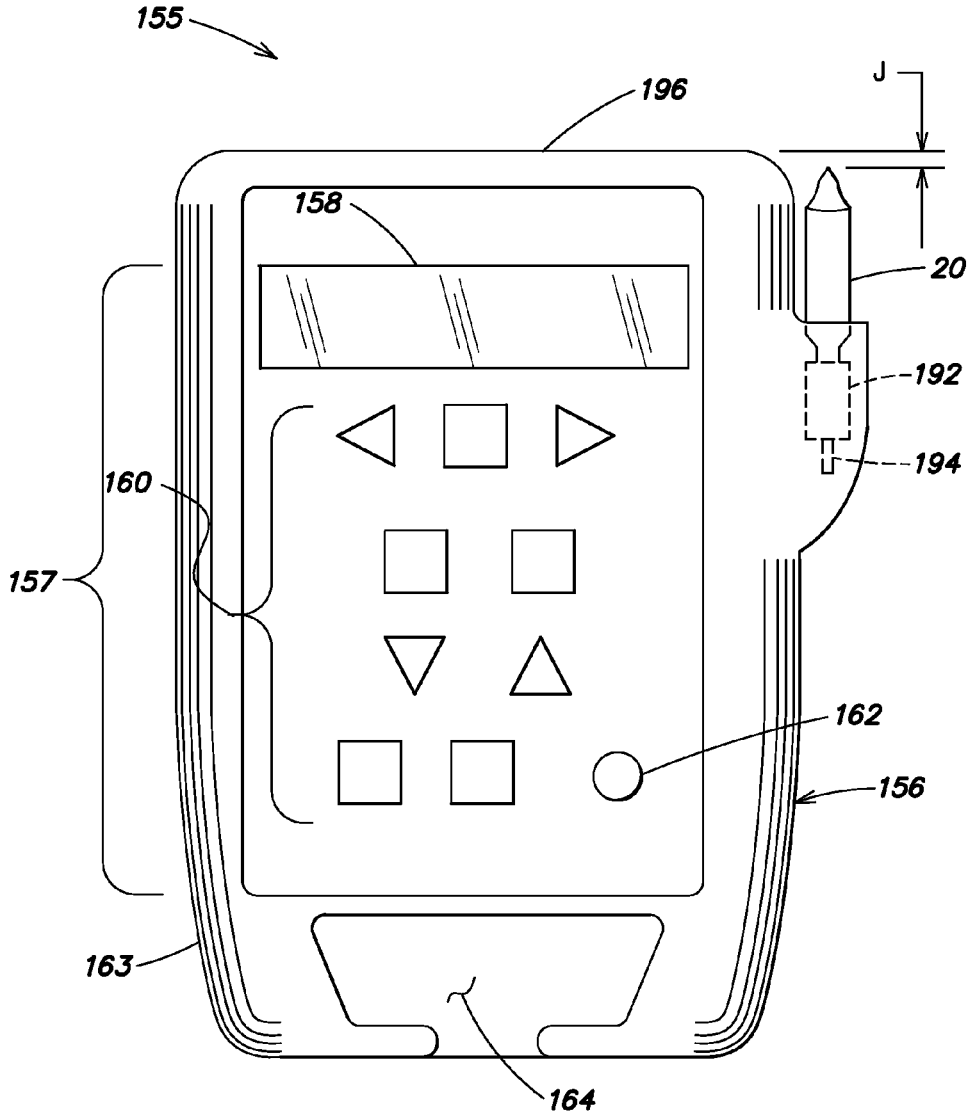
FIG. 12 illustrates a docking station in accordance with a further embodiment.

Referring now to FIG. 12, a system 155 including a docking station 156 and an electronic device 20 is illustrated in accordance with one embodiment. In the illustrated embodiment, the docking station 156 is a hand-held unit and operates to allow a user to download data from the electronic device 20 and display information concerning the flight characteristics of the arrow. In accordance with some embodiments, the docking station 156 also allows data and/or programs to be downloaded to the electronic device 20. The docking station includes a user interface 157 provided by a display 158 and a keypad 160 that includes one or more keys. In accordance with one embodiment, the display 158 is a LCD text display with one or more lines. Further, according to one embodiment, the keypad 160 is a membrane keypad that also includes an on/off or power button 162 that allows a user to turn the docking station 156 on or off. According to one embodiment, the docking station 156 includes a power source such as one or more batteries. According to a version of this embodiment, the docking station 156 is powered by three AA batteries.

According to some embodiments, the docking station 156 is manufactured from plastic in a form factor that allows a user to easily grip the docking station 156 with one hand on either side of the docking station while manipulating the keys of the keypad 160 to operate the docking station to display the desired information concerning flight characteristics of the arrow that the electronic device 20 was employed with. According to one embodiment, the docking station also includes a grip 163 and a pocket or recess 164. According to one embodiment, the grip 163 is provided by a plurality of grooves located along the longitudinal edges of the docking station body. In an alternate embodiment, the grip 163 is provided by a series of raised longitudinal protrusions (or ribs) that extend along the longitudinal edges of the docking station 156.

Figure 13:
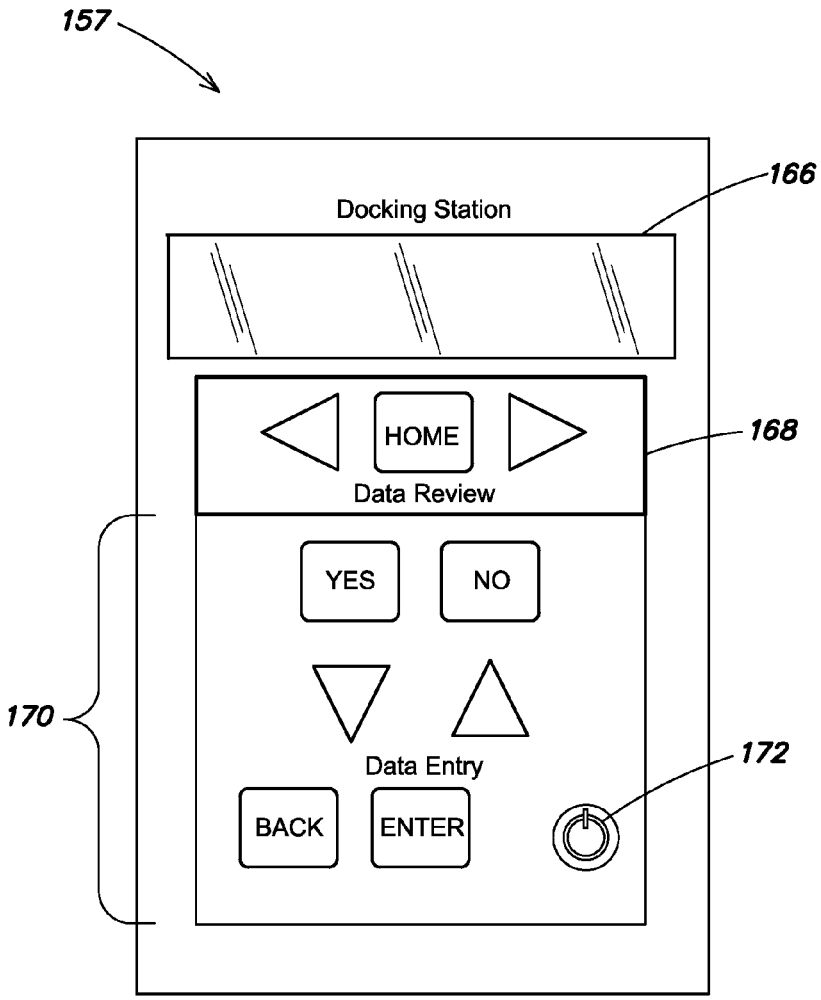
FIG. 13 illustrates a user interface for a docking station in accordance with one embodiment.

The pocket or recess 154 can be provided to allow a user to store electronic device 20 when not in use. Further, the pocket 164 can be employed to store one or more electronic devices configured as a conventional field point when removed from the arrow. Referring now to FIG. 13, the user interface 157 (for example, a membrane keypad) is illustrated in accordance with one embodiment.

In the illustrated embodiment, the membrane keypad includes a window 166, a plurality of data review keys 168 and a plurality of data entry keys 170. According to one embodiment, the window 166 goes over the region of the display 158 when the membrane keypad is located on the docking station.

As mentioned above, the electronic device 20 can be included in an arrow for one or a plurality of flights and collect flight-data for each of the plurality of flights. According to one embodiment, the electronic device 20 is removed from the arrow following a predetermined number of flights and is then connected to the docking station 156, for example, via a connection to the docking station as illustrated in FIG. 12. Thus, according to one embodiment, the docking station includes a receptacle 192 to receive all or a portion of the electronic device 20. In a further embodiment, the receptacle 192 includes threading in compliance with the ATA/ARR-204-2008 technical guidelines for threaded replacement points to allow the docking station to be connected to an electronic device 20 having a threaded shaft that also meets the dimensions provided by these guidelines. The docking station 156 can then be employed to download flight data which may include any of the following alone or in combination: acceleration data, shock sensor operation data, magnetometer output data or other information from the electronic device 20 when it is connected to the docking station 156.

In some embodiments, the docking station 156 provides an electrical connection 194 configured to receive one or more communication contacts included in the electronic device 20. In one embodiment, the electrical connection 194 is configured to provide an electrical connection with a communication conductor in the form illustrated here as the communication conductor 23 in FIG. 1. The electrical connection can also provide a connection to a conductive housing of the electronic device 20. In various embodiments, the electrical connection 194 is employed to communicate flight-data from the electronic device 20 to the docking station 156 or other form of base station. According to another embodiment, the electrical connection 194 is employed to download embedded software from the docking station 156 or other form of base station to the electronic device.

FIG. 12 illustrates a docking station employed with the electronic device 20 configured as an arrowtip. However, in various embodiments, the docking station 156 can provide a hardwired communication connection for other configurations of the electronic device 20. In one embodiment, the docking station provides the electrical connection 194 for use with the electronic device 20 configured as a nock while in another embodiment the docking station 156 provides the electrical connection 194 for use with the electronic device 20 configured as an adapter. Further, in various embodiments, the docking station is configured to provide a hardwired communication interface that allows for a hardwired communication connection to the electronic device 20 while it remains attached to the arrow.

In some embodiments, the dimensions of the docking station 156 and the location of the receptacle 192 are configured to locate the electronic device 20 to recess the distal end of the electronic device 20 relative to an outer surface of the docking station 156. As illustrated in FIG. 12, the distal end is recessed relative to the surface 196 of the docking station by a distance J. The preceding feature can be advantageous in preventing the distal end of the electronic device 20 from accidentally making contact with another object when connected to the docking station.

In various embodiments, the docking station can be equipped for wired or wireless communication with another device, for example, as illustrated with reference to the base station 112 illustrated in FIG. 11.

Figure 18B:
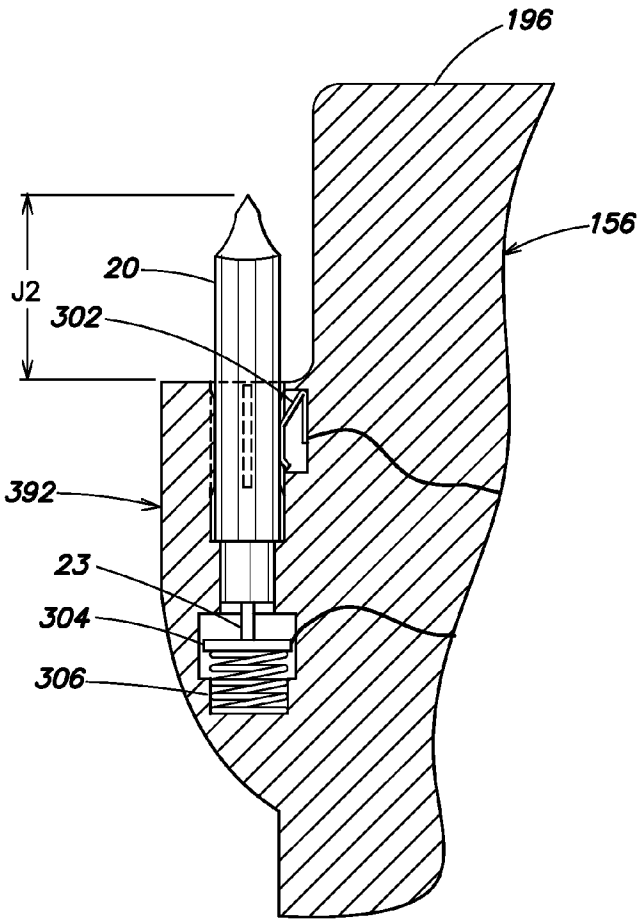
FIGS. 18A and 18B illustrate a sectional view of a docking station in accordance with one embodiment.
Figure 18A:
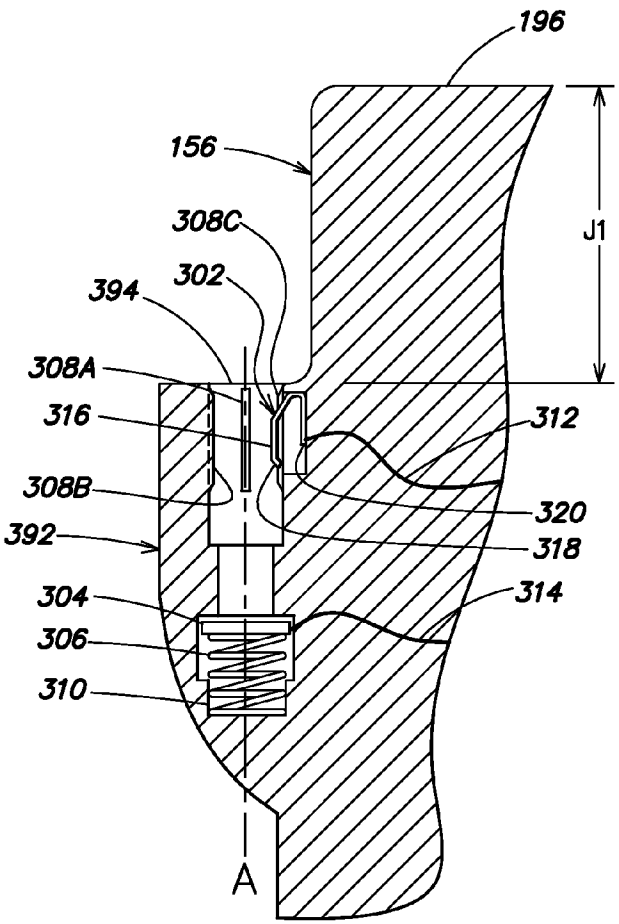

Referring now to FIGS. 18A-18B, further details concerning the electrical connection employed to connect the electronic device 20 to the docking station 156 are illustrated in accordance with one embodiment. FIGS. 18A-18B provide a cross-sectional view of the region of a housing 356 of the docking station 156 where the housing includes a receptacle 392 sized and shaped to receive at least a portion of the electronic device 20. The docking station 156 includes a first electrical contact 302, a second electrical contact 304, a spring 306, ribs 308A, 308B and 308C, contact-retaining structure 310, a first lead 312 and a second lead 314. According to one embodiment, the receptacle 392 includes a mouth 394 that defines the entrance to the receptacle 392 into which the electronic device 20 is inserted to complete a hardwired communication connection. According to the illustrated embodiment, the receptacle 392 is included in an offset region of the housing 356, for example, offset from a sidewall of the docking station.

Further, as mentioned above, the receptacle 392 can be located to recess the distal end of the electronic device 20 when the electronic device is connected to the docking station. As illustrated in FIG. 18A, the mouth 394 of the receptacle 392 is recessed a distance J1 from the surface 196 while the distal end of the electronic device 20 extends a distance J2 from the mouth when fully connected. In one embodiment, the distance J2 is less than J1 to reduce the chance that the distal end of the electronic device 20 is accidentally contacted when the electronic device is docked.

According to some embodiments, the first electrical contact includes a resilient electrical contact that provides a spring bias that tends to act against pressure that is applied against it. In one embodiment, the first electrical contact 302 is formed from sheet metal which is bent back on itself. In this embodiment, the first electrical contact 302 includes a free end 318 and a fixed end 320. The resulting structure provides a contact surface 316 configured to engage a contact surface of the electronic device 20, where pressure applied perpendicular to the contact surface 316 is resisted by the spring-bias provided by the first electrical contact 302. According to one embodiment, the contact surface 316 engages an exterior surface of the electronic device 20, for example the external surface of the body 24. Other hardware configurations can be employed to provide the first electrical contact 302 provided that they apply sufficient pressure to the contact surface of the electronic device 20 to maintain a connection that can be employed in a communication interface.

According to one embodiment, the receptacle 392 includes structure in the form of ribs 308 that are employed to guide the electronic device 20 when it is slid within the receptacle 392, for example, to maintain the electronic device in a substantially central location within the receptacle 392. For example, in one embodiment, the receptacle 392 includes a central longitudinal axis A and the ribs 308 assist in maintaining a central longitudinal axis of the electronic device 20 substantially aligned with the axis A. In one embodiment, the fibs 308 include a central rib 308A and two outer ribs 308B and 308C.

According to one embodiment, the second electrical contact 304 and the spring 306 are discrete elements that are in electrical contact with one another. In another embodiment, the second electrical contact 304 and the spring 306 are provided in an integral unit. Regardless of the configuration, the contact-retaining structure 310 is employed to maintain the electrical contact 304 and the spring 306 in the proper locations within the docking station 156. For example, to maintain the second electrical contact 304 substantially centrally aligned with the axis A. In one embodiment, the first lead 312 and the second lead 314 provide an electrical connection from the first contact 302 and the second contact 304, respectively, to circuitry located elsewhere within the housing 356.

In operation, the electronic device 20 is slid within the receptacle 392 to complete the electrical connection between the docking station 156 and the electronic device 20 for the communication interface. FIG. 18B illustrates the electronic device 20 fully seated within the receptacle 392. The first electrical contact 302 is pressed radially outward relative to the axis A by a force that is substantially perpendicular to the axis A. As a result, the free end 318 of the contact 302 is pressed towards the fixed end 320. Contact pressure between the contact surface 316 and the electronic device 20 results as the spring-bias of the first electrical contact 302 is applied in a direction radially inward relative to both the axis A and the central longitudinal axis of the electronic device 20.

The full insertion of the electronic device 20 within the receptacle 20 also results in the communication conductor 23 (for example, a communication pin) being placed into contact with the second electrical contact 304. The second electrical contact 304 is pressed against the spring 306 once the communication conductor engages the contact 304. The compression of the spring 306 provides a spring bias in a direction opposite the direction in which the electronic device 20 is inserted within the receptacle 392. The result is that contact pressure is created between the proximate end of the communication contact and the surface of the second electrical contact 304. Other types of structure can be used for the second electrical contact 304 provided that they are configured to provide contact pressure on the communication conductor 23. According to other embodiments, the second electrical contact 304 includes structure that contacts the radially outer surface of the communication conductor 23, for example, about all or a portion of the circumference of the communication conductor.

According to the above embodiments, the structure of the docking station 156 and the electronic device 20 allow the use of a single wire communication interface in which an element of the housing 21 is employed as a conductor in addition to the communication conductor 23. Such an approach can result in decreasing the form factor of the electronic device 20 by minimizing the quantity of communication conductors required to transfer information (for example, download data) to/from the electronic device 20.

Further, according to various embodiments, a contact surface 322 provided by the housing 21 is located around all (for example, 360 degrees) or a portion of an outer surface of the housing 21. According to one embodiment where the contact surface 322 is provided about a full 360 degrees of the circumference of the housing 21, electrical contact is completed when the electronic device 20 is inserted within the housing 356 regardless of the rotational position of the electronic device about the axis A. According to another embodiment, the contact surface 322 is provided about less than a full 360 degrees of the circumference of the housing 21. According to this embodiment, a limited number of rotational positions of the electronic device 20 within the receptacle are available to complete the electrical connection with the docking station 156. Thus, in some embodiments, the electronic device 20 and the housing 356 can be keyed to insure that the electronic device 20 is in the correct orientation to complete the electrical connection.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An apparatus configured to couple to an arrow-mounted electronic device, the apparatus comprising:

a housing independent of each of an arrow and the arrow-mounted electronic device with the arrow-mounted electronic device included in the arrow when the arrow is shot from a bow;

a receptacle included in the housing and configured to receive at least a portion of the arrow-mounted electronic device; and at least one electrical contact configured to couple to a contact included in the arrow-mounted electronic device, the at least one electrical contact having a spring-bias in a first direction, wherein the spring-bias is opposed with the arrow-mounted electronic device inserted within the receptacle.

2. The apparatus of claim 1 wherein the at least the portion of the arrow-mounted electronic device is inserted within the receptacle in a second direction that is substantially perpendicular to the first direction.

3. The apparatus of claim 1, wherein the receptacle is configured to receive the at least the portion of the arrow-mounted electronic device after the electronic device is removed from the arrow.

4. The apparatus of claim 1, wherein the first direction is radially inward relative to a central longitudinal axis of the arrow-mounted electronic device when the electronic device is received by the receptacle.

5. The apparatus of claim 1, wherein the at least one electrical contact includes a first electrical contact, wherein the contact included in the arrow-mounted electronic device includes a first device-contact, and wherein the apparatus includes a second electrical contact configured to couple to a second device-contact included in the arrow-mounted electronic device.

6. The apparatus of claim 5, wherein the first device contact is located about a radially exterior surface of the arrow-mounted device.

7. The apparatus of claim 1, wherein the receptacle is located to provide a first distance from an exterior wall of the housing to a mouth of the receptacle, and wherein the first distance is greater than or equal to a second distance determined as a distance at which an end of the arrow-mounted electronic device projects from the mouth of the receptacle when the arrow-mounted electronic device is fully-received by the receptacle.

8. The apparatus of claim 1, further comprising a user interface housed by the housing.

9. A method of making an electrical connection to an arrow-mounted electronic device, the method comprising:

receiving at least a portion of the arrow-mounted electronic device within a housing by inserting the at least the portion of the arrow-mounted electronic device in a first direction within the housing; and biasing at least one electrical contact included in the housing in a second direction to couple to a contact included in the arrow-mounted electronic device in a sliding engagement when the at least a portion of the arrow-mounted electronic device is received within the housing.

10. The method of claim 9, wherein the second direction is substantially perpendicular to the first direction.

11. The method of claim 9, further comprising removing the arrow-mounted electronic device from an arrow prior to the act of receiving.

12. The method of claim 9, further comprising locating a receptacle in the housing to receive the at least the portion of the arrow-mounted electronic device.

13. The method of claim 12, wherein the receptacle includes a mouth, wherein the method further comprises:

determining a first distance from an exterior wall of the housing to the mouth of the receptacle as measured in a direction parallel to the second direction; and locating the mouth of the receptacle such that the first distance is greater than or equal to a second distance determined as a distance at which an end of the arrow-mounted electronic device projects from the mouth of the receptacle when the arrow-mounted electronic device is fully-received within the receptacle.

14. The method of claim 9, further comprising spring-biasing the at least one electrical contact such that the second direction is radially inward relative to a central longitudinal axis of the arrow-mounted electronic device when the electronic device is received by the housing.

15. An arrowtip comprising:

a body including a cavity configured to receive at least a portion of a circuit board;

a shaft attached to a proximate end of the body; and a cap configured as a distal end of the arrowtip and for removable attachment with the body, wherein at least one wall of the cavity includes a slot configured to receive an edge of the circuit board.

16. The arrowtip of claim 15, wherein the slot includes a plurality of walls, wherein the circuit board includes a contact, and wherein the contact is located on the circuit board to make an electrical connection between the circuit board and the body via at least one of the plurality of walls with the circuit board installed in the body.

17. An arrowtip comprising:

a body including a cavity configured to receive at least a portion of a circuit board;

a shaft attached to a proximate end of the body; and a cap configured as a distal end of the arrowtip and for removable attachment with the body wherein the cap and the body are configured such that the cap is rotated into engagement with the body to attach the cap to the body to fully assemble the arrowtip, and wherein, with the cap remaining attached to the body, an electrical circuit is disconnected when the cap is rotated in a direction that increases an overall axial length of the arrowtip.

18. The arrowtip of claim 17, wherein each of the body and the cap are electrically conductive.

19. An arrowtip comprising:

a housing including:

a first portion configured to receive at least a portion of a circuit board;

a second portion configured for attachment to the first portion; and a shaft coupled to one of the first portion and the second portion, the shaft configured to attach the housing to an arrow, wherein the first portion and the second portion are rotated into engagement with one another to attach the second portion and the first portion together, assemble the arrowtip, and complete an electrical connection employed in a circuit included in the arrowtip, and wherein to assemble the arrowtip the first portion and second portion are rotated relative to one another to decrease an overall axial length of the arrowtip.

20. The arrowtip of claim 19, wherein the first portion and the second portion each include threads employed to attach the second portion and the first portion together.

21. The arrowtip of claim 19, wherein the second portion is configured to house a battery power source.

22. The arrowtip of claim 21, wherein the circuit includes a power circuit configured to provide power to the circuit board.

23. The arrowtip of claim 21, wherein the second portion is configured to house the battery power source including at least one coin cell battery.

24. The arrowtip of claim 19, wherein the circuit included in the arrowtip is independent of other components included in the arrow with the housing attached to the arrow.

25. The arrowtip of claim 24, wherein the other components include an arrow shaft.

26. The arrowtip of claim 19 wherein, with the second portion remaining attached to the first portion, the electrical connection is disconnected when the first portion and second portion are rotated relative to one another to increase the overall axial length of the arrowtip.

27. The arrowtip of claim 19, wherein a minimum axial length of the arrowtip results with the first portion and the second portion fully engaged.

28. The arrowtip of claim 19, further comprising an electronic apparatus and power management circuitry each located in the housing, wherein the power management circuitry is configured to place the electronic apparatus in an operational state prior to a release of the arrow from a bow.

29. The arrowtip of claim 19, further comprising an electronic apparatus and power management circuitry each located in the housing, wherein the power management circuitry is configured to place the electronic apparatus in an operational state at a release of the arrow from a bow.

30. An apparatus configured to couple to an electronic archery device, the electronic archery device configured for inclusion in an arrow when shot from a bow, the apparatus comprising:

a housing independent of each of the arrow and the electronic archery device with the electronic archery device included in the arrow when shot from the bow;

a receptacle included in the housing and configured to receive at least a portion of the electronic archery device; and at least one electrical contact included in the housing and configured to couple to a contact included in the electronic archery device, wherein, with at least a portion of the electronic archery device received by the receptacle, the at least one electrical contact and the contact included in the electronic archery device form an electrical connection.

31. The apparatus of claim 30, wherein the apparatus is configured to couple to the electronic archery device including an arrow point.

32. The apparatus of claim 30, wherein the at least one electrical contact is configured to couple to a contact surface included in a housing of the electronic archery device.

33. The apparatus of claim 30, wherein the at least one electrical contact is configured to couple to a contact surface located on an exterior of the electronic archery device.

34. The apparatus of claim 33, wherein the at least one electrical contact is configured to couple to the contact surface located on the exterior of a housing including the electronic archery device.

35. The apparatus of claim 30, wherein the housing is configured to be handheld.

36. The apparatus of claim 30, wherein the electrical connection is included in a communication circuit.

37. An apparatus configured to couple to an electronic archery device, the electronic archery device configured for inclusion in an arrow when shot from a bow, the apparatus comprising:

a housing independent of the arrow and the electronic archery device;

a receptacle included in the housing and configured to receive at least a portion of the electronic archery device; and at least one electrical contact included in the housing and configured to couple to a contact included in the electronic archery device, wherein, with at least a portion of the electronic archery device received within the receptacle, the at least one electrical contact and the contact included in the electronic archery device complete a resilient electrical connection included in recharging circuit configured to recharge a power source employed by the electronic archery device.

38. The apparatus of claim 30, wherein the receptacle is configured to receive the electronic archery device with the electronic archery device included in the arrow.

39. The apparatus of claim 30, wherein the apparatus is configured to receive the electronic archery device by plugging the electronic archery device in the receptacle.

40. The apparatus of claim 30, wherein the electrical connection includes a resilient electrical connection.

41. The apparatus of claim 30, wherein the receptacle is configured to receive within it at least a portion of the housing of the electronic archery device.

* * * * *